US006875278B2

(12) United States Patent
Kerbel et al.

(10) Patent No.: US 6,875,278 B2
(45) Date of Patent: Apr. 5, 2005

(54) MODULAR POWDER APPLICATION SYSTEM

(75) Inventors: Darrell A. Kerbel, Skokie, IL (US); Sang Rhee, Naperville, IL (US); Ted B. Kumzi, Oak Lawn, IL (US); Don K. Sheldon, Buffalo Grove, IL (US); Deirk A. Feiner, Bolingbrook, IL (US); Merethe Pepevnik, Arlington Heights, IL (US); Bernard Y. Conyers, III, Jefferson City, MO (US)

(73) Assignee: Material Sciences Corporation, Elk Grove Village, IL (US)

( * ) Notice: Subject to any disclaimer, the term of this patent is extended or adjusted under 35 U.S.C. 154(b) by 105 days.

(21) Appl. No.: 09/948,103

(22) Filed: Sep. 7, 2001

(65) Prior Publication Data

US 2003/0066481 A1 Apr. 10, 2003

(51) Int. Cl.[7] ..... B05C 5/00

(52) U.S. Cl. ..... 118/620; 118/625; 118/308; 118/323; 118/326; 239/693; 427/475; 427/480; 427/180

(58) Field of Search ..... 118/620, 624, 118/625, 626, 631, 308, 309, 323, 326; 239/693, 695, 750; 427/459–475, 480, 180; 222/148, 196, 216, 410, 630

(56) References Cited

U.S. PATENT DOCUMENTS

| | | | | | |
|---|---|---|---|---|---|
| 4,111,152 | A | * | 9/1978 | Sakamoto | 118/688 |
| 4,826,703 | A | * | 5/1989 | Kisler | 427/469 |
| 5,397,605 | A | * | 3/1995 | Barbieri | 427/485 |
| 5,654,042 | A | * | 8/1997 | Watanabe et al. | 427/459 |
| 5,769,276 | A | * | 6/1998 | Alexander | 222/148 |
| 5,996,855 | A | * | 12/1999 | Alexander et al. | 222/318 |
| 6,120,832 | A | * | 9/2000 | Walsh et al. | 427/8 |
| 6,569,494 | B1 | * | 5/2003 | Chambers et al. | 427/180 |

* cited by examiner

*Primary Examiner*—Chris Fiorilla
*Assistant Examiner*—Michelle Acevedo Lazor
(74) *Attorney, Agent, or Firm*—Liniak, Berenato & White, LLC

(57) ABSTRACT

A powder atomizer comprises a rotatable powder conveying brush operably associated with a powder supply. A powder receptacle has an inlet and an outlet. The powder conveying brush extends along the inlet and supplies powder to the receptacle. A rotatable powder metering brush is operatively associated with the outlet and withdraws powder from the receptacle. A rotatable powder atomizing brush is operatively associated with and receives powder from the metering brush and discharges the powder. A shoe is operatively associated with the atomizing brush, and is pivotable about a pivot axis between a first and a second position.

54 Claims, 28 Drawing Sheets

MODULAR POWDER APPLICATION SYSTEM

FIELD OF THE INVENTION

The disclosed invention is a modular powder application system for applying powder paint, powder coatings, and like fine powders to moving webs of continuous strip material, such as steel strip. More particularly, the disclosed invention is a powder application system having a powder atomizer module and an electrostatic coating module, with the modules secured together when in an operating condition and adapted to be displaced relative to each other when in a non-operating condition, in order to permit cleaning, service, etc. as may be required.

BACKGROUND OF THE INVENTION

The application of powder paint, powder coatings, etc to lengths of continuous moving strip material has been achieved through use of electrostatic spray guns and electrostatic application chambers in which powder, in atomized form, is caused to be attracted to the strip through use of charging electrodes positioned. Electrostatic spray guns are limited by the speed at which the strip may move and the rate at which the powder may be applied. Similarly, the electrostatic application chambers are limited by the rate at which powder can be applied to the strip, thus limiting use of these technologies for coating moving strips of material.

One drawback to electrostatic application chambers is the service requirements, either on account of routine maintenance or because the powder needs to be changed, as may occur when the type or color of the powder is changed. In those events, the coating line has to be stopped for an excessively long period, and the electrostatic coating apparatus essentially taken apart. This greatly limits the utility of the powder application system, and also increases the cost of the resulting coated product.

The electrostatic application of powder paint can be advantageously utilized with different non-metals and metals, such as steel and aluminum, and with strips of different widths. The electrostatic powder application system can be fit into a relatively small footprint, thus eliminating the cost and space of accumulator towers and their sophisticated control assemblies. However, it still is preferred that the tail end of one strip be secured to the lead end of the next to be coated strip, in order to maximize productivity of the coating system. Typically, a stitch is used to connect the tail end to the lead end, but the stitch may extend from one or both strips by such an extent that it may damage the electrostatic coater when it passes through the coating apparatus.

Commercially coated strip product must have a uniform coating thickness and a uniform appearance. Rotating auger brushes have in the past been used to move the powder paint from a hopper to a receptacle from which it is drawn and atomized by other rotating brushes. The powder in the receptacle must have a uniform depth, in order to maintain a uniform head assuring uniform removal. Uniform removal is important to uniform deposition, and thus coating thickness or weight and appearance. We have found that auger brushes do not achieve uniform depths of powder in the receptacle, and instead provide more powder proximate the hopper and less powder at the opposite end. Merely increasing the speed of rotation of the auger brush does not solve this problem, and may instead create a different problem due to the sag in the brush which may occur due to its length.

Because of brush sag, powder may actually be thrown from the receptacle when the speed of rotation is increased.

Typical continuous web powder coating systems utilize a shoe which cooperates with the rotating feeder and atomizing brushes to guide the powder before its is launched into the coating zone. The shoes in the past have been formed from a plurality of individual shoe segments, which were held together by compressive forces. Such a shoe was relatively lightweight, but the compressive forces were generally insufficient to overcome sag of the shoe due to its length and permitted small gaps to be created at abutting sections. The strips to be coated can be up to 108 inches wide, and the shoe must be at least that length. Efforts to shim the shoe segments and otherwise overcome the effect of sag and the formation of gaps were generally unsuccessful.

Moreover, because of the tight fit of the shoe to the feeder and atomizing brushes, the shoe made cleaning those brushes and the powder application chamber difficult. The brushes and chamber typically are cleaned with pressurized air, a task made difficult because of the presence and location of the shoe.

As noted, the strip material can have a width of up to 108 inches. The brushes, shoe, and other components must therefore have at least a corresponding length. We have found that the atomizing brush, which rotates at a speed sufficiently high to atomize the powder and expel it centrifugally into the electrostatic coating zone, tends to sag at such long lengths. Moreover, when supported by radial bearings, as has typically been done, the brush tended to vibrate excessively due to its natural frequency of vibration. With radial bearings, this was a speed below the operating speed of the brush. The vibrations tended to damage the equipment, and to throw powder from the atomizer in an uncontrolled way.

The typical powder atomizing system also utilizes a "wing" in cooperation with the atomizing brush to direct the atomized powder into the coating zone. Once set, the wing was fixed in position, regardless of whether the orientation was optimum for the powder being applied or the strip being coated.

Powder application systems can be used to electrostatically apply powder to both surfaces of the strip. Sometimes only one surface is to be coated, however. Although the coaters can be arranged in any orientation, a typical orientation is for the strip to move horizontally. In that event, there is a coater for the upper surface and a coater for the lower surface. The electrostatic coating zone is typically a box-like rectangular assembly. Powder tends to accumulate at corners and on flat surfaces. Once sufficient powder has accumulated, then gravity causes the accumulated clump to fall onto the below moving strip. In that event, a portion of the strip has a non-uniform surface, and is not commercially saleable.

The coating thickness is a function of the speed of the strip and the rate at which powder is atomized. Typical coating systems in the past had a single coater, which applied powder to one surface on one pass and to the other on another pass. This was a slow process. Additionally, because the atomizing rate was essentially fixed, then the strip speed was used to regulate coating thickness.

SUMMARY OF THE INVENTION

The disclosed and claimed invention is an electrostatic powder application system formed from a powder atomizer module and an electrostatic coating module. The modules are adapted to be displaced relative to each other in order to enhance maintenance and cleaning. Each system comprises one of each such module, and there may be a plurality of such systems arrayed along each surface to be coated. The systems are independently operable, in order to permit application of powder as may be desired and as needed to permit sufficient or specified coating weight.

Additionally, the atomizer module has a one-piece weldment shoe pivotable between an operating position and a maintenance or cleaning position. Similarly, the wing is adjustable while installed on the atomizer module, to permit maximum regulation of the powder throughput. The atomizing brush is supported by angular contact bearings, which permit a more taut construction, while achieving a natural vibration that is far higher than the operating speed of the atomizing brush.

Moreover, the auger brush used to supply powder to the receptacle has a varying pitch which maintains relatively uniform depths of powder within the receptacle. The auger brush has a plurality of pitches, with the pitch increasing by a uniform amount along the effective length of the receptacle.

A brush for conveying powder in a powder applicator includes an axially extending rotatable shaft. A plurality of deformable members extend radially from and helically along the shaft. A gap is disposed between adjacent turns of the helix, and the gaps define a pitch, with pitch varying along the axis.

A powder feeder for conveying powder from a powder supply to a powder discharging device includes a rotatable brush operably associated with the supply for withdrawing powder from the powder supply. The brush includes a shaft and a plurality of deformable members. The deformable members extend axially from and helically along the shaft. A gap is disposed between adjacent turns of the helix and the gaps define a pitch, that varies along the shaft. A powder receptacle for containing the powder withdrawn from the powder supply by said brush has an inlet for receiving the powder and an outlet for discharging the powder. The brush extends along the powder receptacle.

A powder delivery device for delivering powder from a powder feeder to a powder atomizer or to a substrate has a rotatable shaft with a plurality of deformable bristles extending therefrom for conveying powder from a first position to a second position. First and second angular contact bearing assemblies are mounted to the shaft at opposite ends thereof and facilitate rotation of the shaft. First and second seal assemblies are disposed about the shaft in cooperation with the bearing assemblies to reduce contamination of powder during rotation of the shaft.

A modular powder application system for coating at least one side of a continuous moving substrate with powder from a powder supply includes an atomizer module in operative communication with a powder supply. Actuation of the atomizer module causes powder to be discharged from the atomizer module as a cloud of particulate material. An electrostatic coating module is operatively associated with the atomizer module and selectively displaceable relative to the atomizer module. The electrostatic coating module comprises at least one charging electrode creating an electric field. The electrostatic coating module receives the cloud of particulate material from the atomizer module. Substrate material positioned within the electrostatic coating module will attract and thereby be coated with the particulate material within the cloud.

A system for coating at least one side of a continuous moving substrate with powder from a powder supply and for allowing enhanced access to an operator for maintenance of the system includes a powder atomizer in operative communication with a powder supply. Actuation of the powder atomizer causes the powder to be discharged as a cloud of particulate material. At least one charging electrode is operatively associated with and displaceable relative to the powder atomizer and cooperates with the cloud of particulate material, so that particulates from the powder atomizer are electrostatically attracted to a substrate adjacent the charging electrode.

A system for electrostatically applying powder to at least one side of a continuous moving substrate with powder from a powder supply includes a powder application system comprising a powder atomizer in operative communication with a powder supply. Actuation of the powder atomizer causes powder to be discharged from the atomizer. An electrostatic coater is operatively associated with the atomizer. The electrostatic coater includes at least one charging electrode creating an electric field, causing the powder to be attracted to the substrate as the substrate travels adjacent to the electrostatic coater. A cover at least partially covers the atomizer and electrostatic coater. The cover defines a gap through which the substrate travels. An actuating assembly is operatively connected to the cover and at least one of the atomizer and the electrostatic coater, and selectively spaces the cover relative to the atomizer and the electrostatic coater between an operating position and a non-operating position.

A powder atomizer comprises a rotatable powder conveying brush operably associated with a powder supply. A powder receptacle has an inlet and an outlet, and the powder conveying brush extends along the inlet and supplies powder to the receptacle. A rotatable powder metering brush is operatively associated with the outlet and withdraws powder from the receptacle. A rotatable powder atomizing brush is operatively associated with and receives powder from the metering brush and discharges the powder. A shoe is operatively associated with the atomizing brush, and the shoe is pivotable about a pivot axis between an operating and a non-operating position.

A one-piece shoe for a powder atomizing system comprises a laterally extending contoured integral support having an upstream end and a downstream end. The support has a surface including at least first and second arcuate portions extending in spaced relation from the downstream end toward the upstream end. A plurality of reinforcing ribs extends in spaced parallel relation from the support from a surface disposed opposite the first mentioned surface. An outer pair of the ribs include a pivotal mounting, so that the support may be pivoted between an operating position and a non-operating position.

A system for coating at least one surface of a substrate moving through a powder application system comprises a powder atomizer in operative communication with a powder supply. Actuation of the powder atomizer causing the powder to be discharged from the atomizer. An electrostatic coater is operably associated with the powder atomizer and comprises at least one charging electrode creating an electric field acting upon the discharged powder and causing the powder to be attracted to a substrate operably positioned within the electrostatic coater. An arcuate guide extends within the electrostatic coater. The guide directs the discharged powder toward and within the electrostatic coater.

This invention will now be described with respect to certain embodiments thereof, along with reference to the accompanying illustrations.

DETAILED DESCRIPTION OF THE INVENTION

Figure 1:
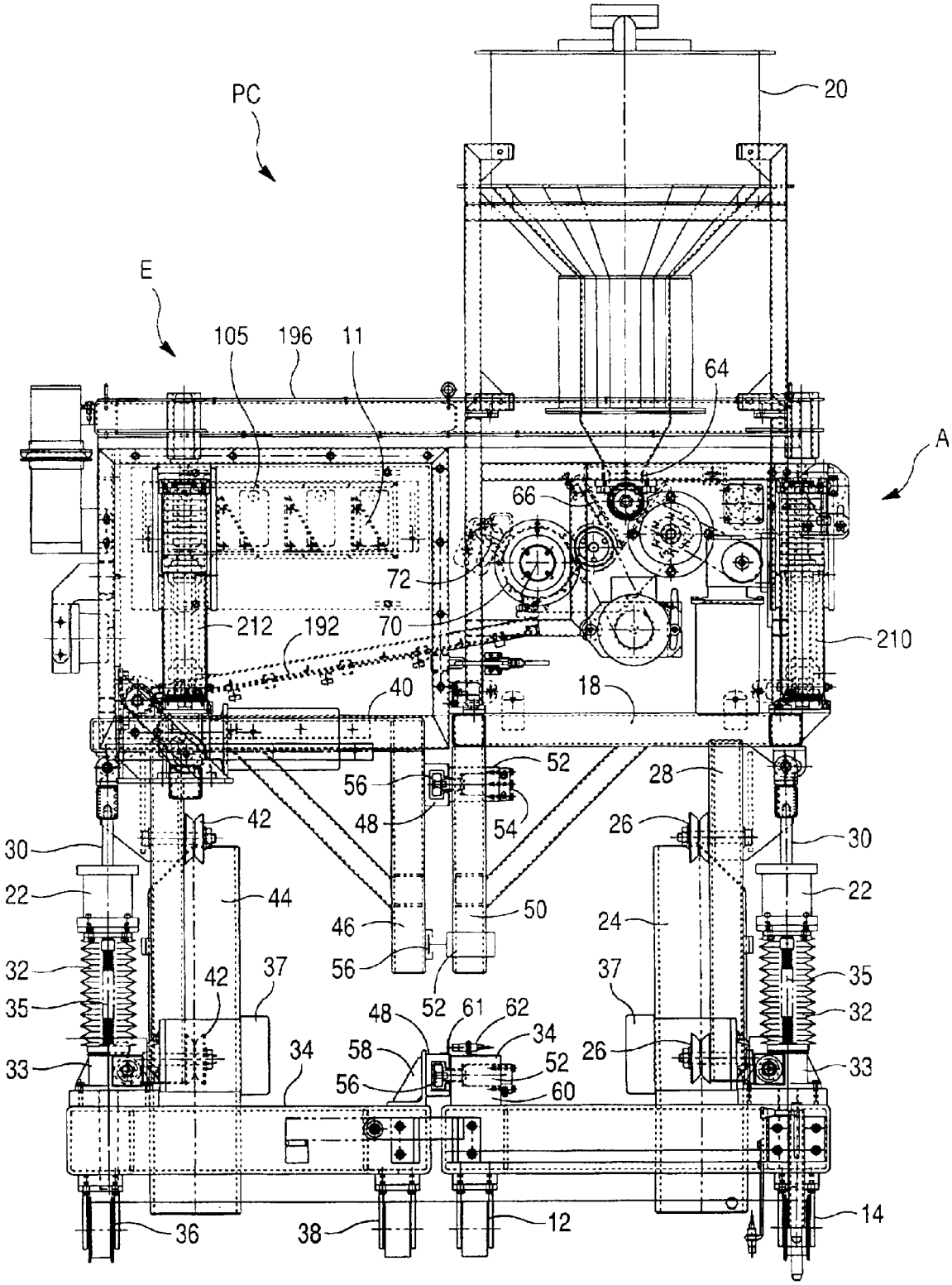
FIG. 1 is a side elevational view with dotted lines illustrating internally located parts of a modular powder application system according to the invention.

Powder application system PC of FIG. 1 includes a powder atomizer module A and an adjacently disposed and cooperating electrostatic coating module E. The powder application system PC of FIG. 1 is particularly adapted for electrostatically applying a fine powder, such as powder paint, to a first or lower surface of continuously moving substrate, such as steel sheet. Powder application system PC1 of FIG. 2 likewise has a corresponding powder atomizer module A1 and an adjacently disposed and cooperating electrostatic coating module E1. Powder application system PC1 is particularly adapted for electrostatically applying fine powder, such as powder paint, to continuously moving substrate, such as steel sheet. The powder application systems PC and PC1 are preferably disposed on opposite sides of the moving substrate, and preferably are spaced along the longitudinal or direction of movement of the substrate. Although the powder application systems PC and PC1 are illustrated as applying powder to a horizontally disposed strip, the powder application systems PC and PC1 may be positioned in any convenient orientation.

Figure 13:
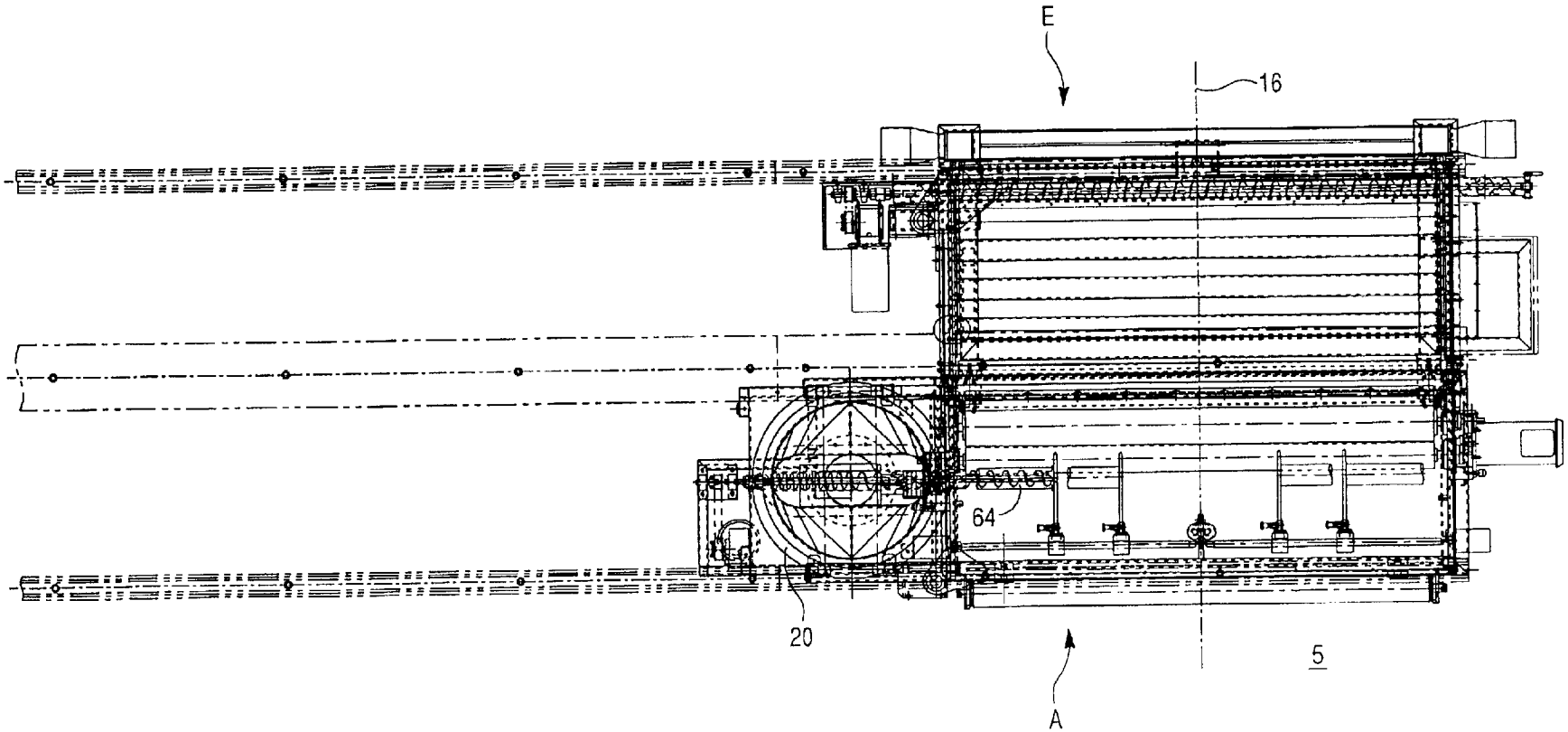
FIG. 13 is a top plan view of the powder application system of FIG. 1.
Figure 14:
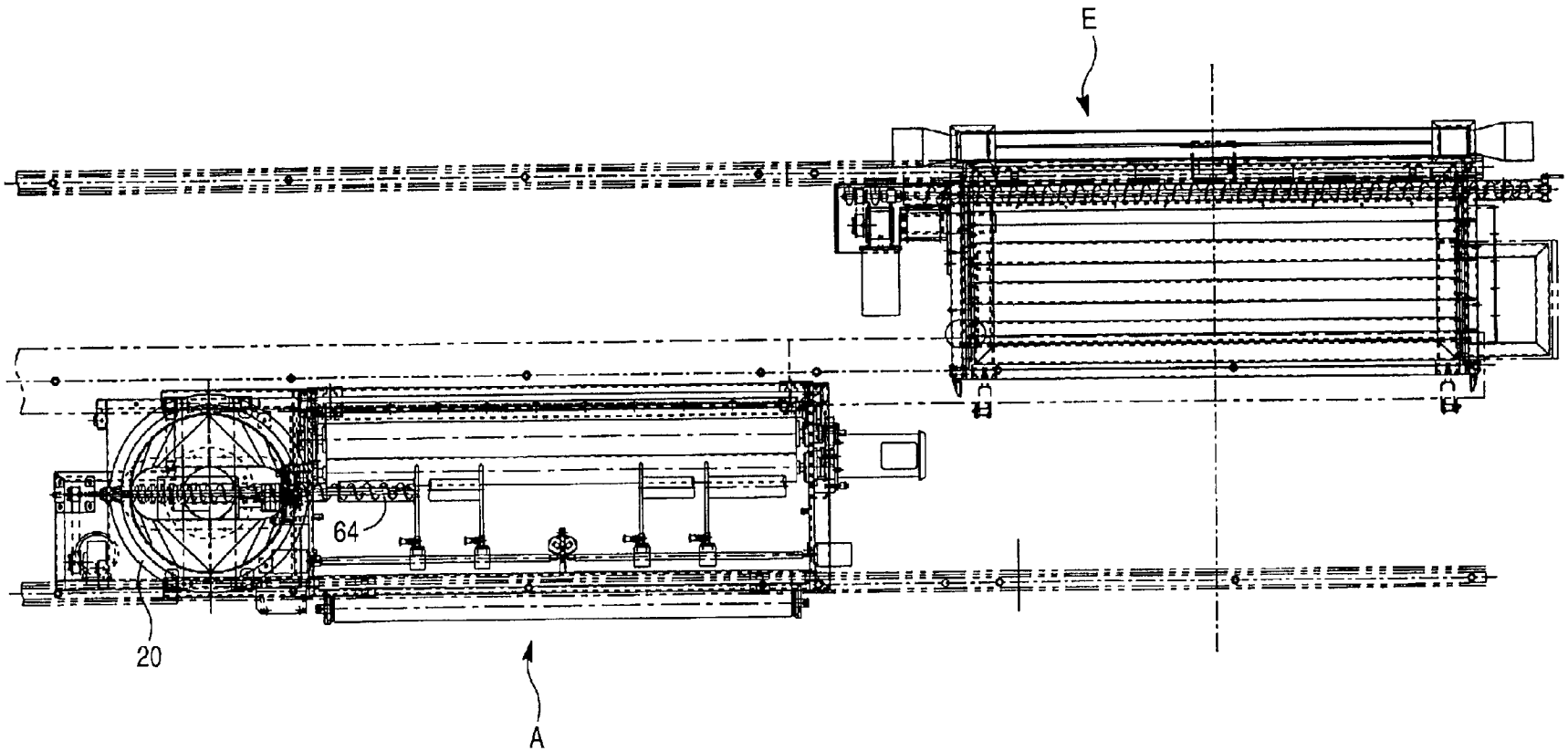
FIG. 14 is a top plan view of the powder application system of FIG. 1 with the atomizer module and the electrostatic coating module in spaced position.

Powder atomizer module A of FIG. 1 includes a lower frame 10 having rollers 12 and 14 permitting the lower frame 10 and thereby the powder atomizer module A to be translated relative to the electrostatic coating module E, as best shown in FIG. 14, when the modules A and E are not secured together. The modules A and E may be translated or moved relative to one another transverse to the movement direction of the substrate material, in order to permit access to either module for cleaning and maintenance purposes. When the modules A and E are in the operational position of FIG. 13, then substrate material S moving in the direction 16 may be coated with the electrostatically applied powder paint. The modules A1 and E1 of the powder application system PC1 are not movable relative to each other, however.

Atomizer module A has an upper frame 18 to which a powder feed and atomizing system is attached in order to communicate powder from hopper 20. Pneumatic cylinder 22 and its piston 30 interconnect lower frame 10 to upper frame 18. Preferably, support 24 upwardly extends from upper frame 10 and cooperates with the rollers 26 secured to support 28 depending from upper frame 18. In this way, operation of cylinder 22 and extension of piston 30 permits guided vertical movement of upper frame 18 relative to lower frame 10. Additionally, we provide a screw jack assembly 32 comprising a rotatable jack 33 and extensible screw 35. The jack 33 is driven by variable speed motor 37. There is a screw jack assembly 32 and a corresponding cylinder 22 and piston 30 at each corner of the powder coating system PC. Electrostatic coating module E likewise has a lower frame 34 carrying rollers 36 and 38 in order to permit vertical translation of electrostatic coating module E relative to atomizer module A. As with atomizer module A, electrostatic coating module E includes an upper frame 40 from which V-rollers 42 depend for engagement with support 44 extending from lower frame 34. Similar cylinders 22 and piston assemblies 30 and screw jacks 32 extend between upper frame 40 and lower frame 34. Actuation of the cylinder 22 causes extension and retraction of piston 30 and thereby displacement of the upper frame 40. The screw jacks 32 permit precise control over the position of atomizer module A and electrostatic coating module E, in order to accommodate differences in the position of the strip S due to its thickness, tension, etc. The pneumatic cylinder 22 thus provides a rough positioning, with operation of the screw jack assembly 32 permitting fine control, which may permit pitch and yaw to be given to the powder application system PC.

Figure 11:
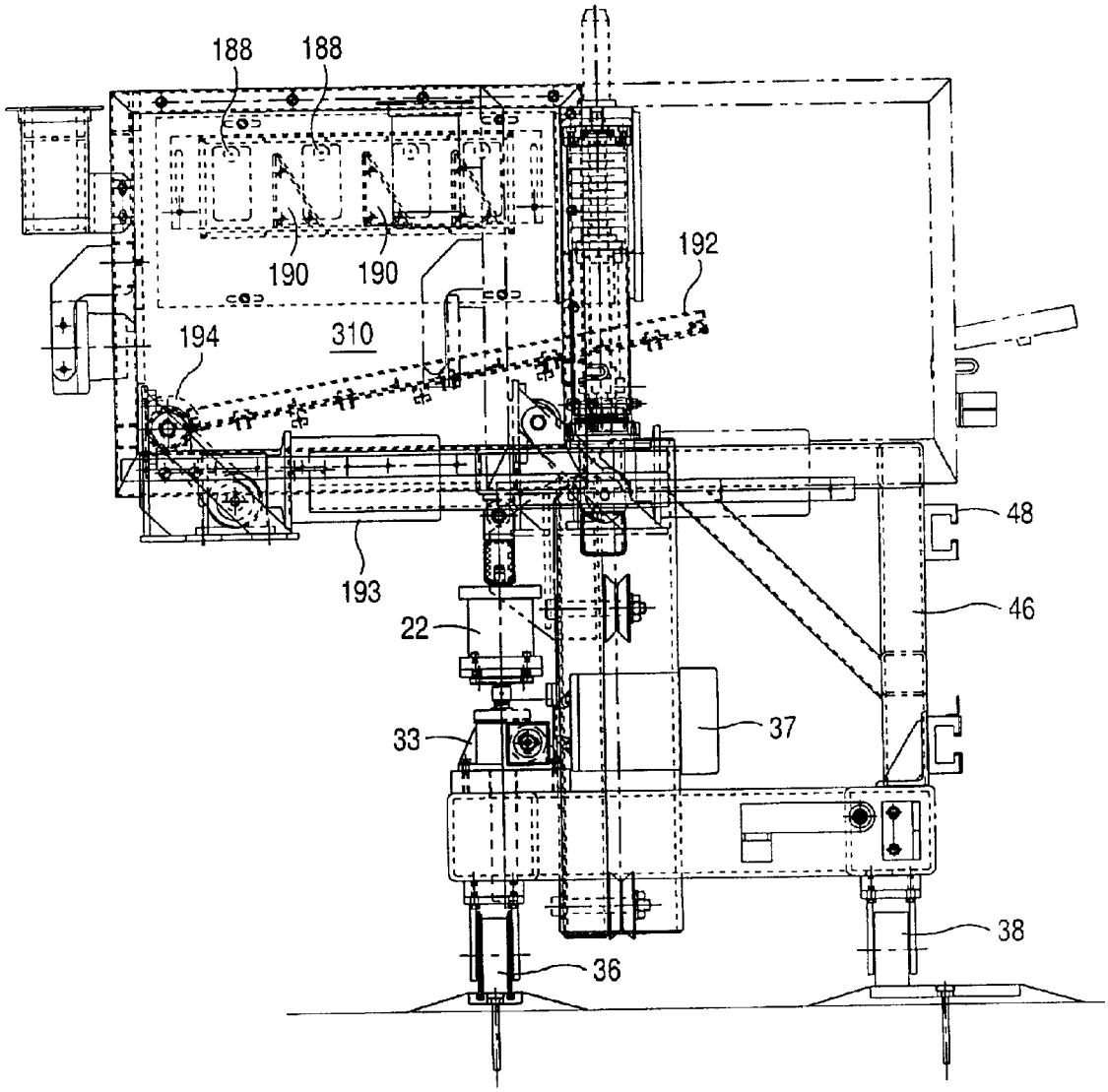
FIG. 11 is a side elevational view of an electrostatic coating module, with the electrodeenclosure in the retracted orientation.

Support 46 extends from upper frame 40 and has a C-shaped bracket 48 opening toward atomizer module A, as best shown in FIGS. 1 and 11. A support 50 extends from upper frame 18 adjacent support frame 46. A cylinder and piston assembly 52 is secured to bracket 54, so that locking element or disk 56 may be selectively positioned within bracket 48. Actuation of cylinder and piston assembly 52 causes the locking element 56 to engage bracket 48, thus securing atomizer module A to electrostatic coating module E. Correspondingly, extension of the piston will cause the locking element 56 to be moved out of engagement with bracket 48, thereby releasing the modules A and E. A similar C-shaped bracket 48 is secured to lower frame 34, such as by brace 58, so that it may receive a corresponding locking element 56 of adjacent cylinder and piston assembly 52 secured to brace 60. Preferably there are like locking mechanisms on both lateral sides of modules A and E.

Extending from the bracket 48 carried by brace 58 is a plate 61 that confronts sensor 62. The sensor 62 is in electrical communication with a control module. The control module determines whether the modules A and E are secured together in the operational position. The control module, in response to the signal from sensor 62, permits operation of the powder application system PC when the atomizer module A is secured to the electrostatic coating module E through actuation of the cylinder and piston assemblies 52. If the modules A and E are not secured together in the operational position, then the powder application system PC is not permitted to operate.

Figure 3:
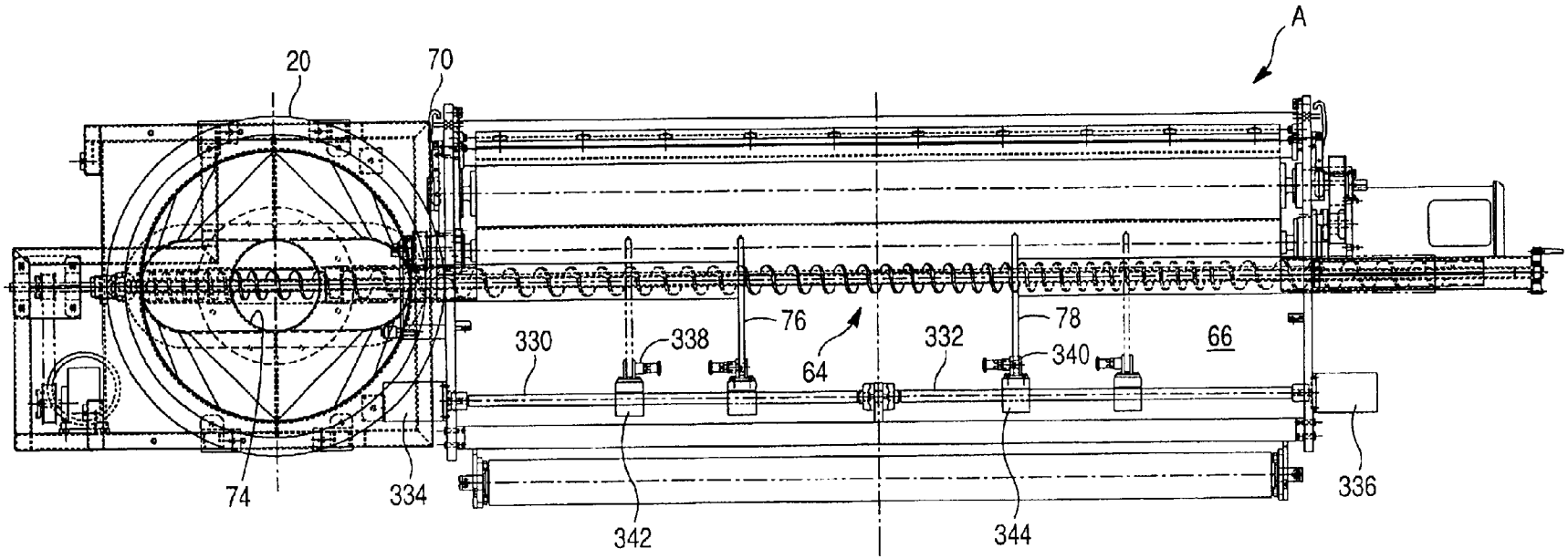
FIG. 3 is a top plan view of a powder atomizer according to the invention.
Figure 9:
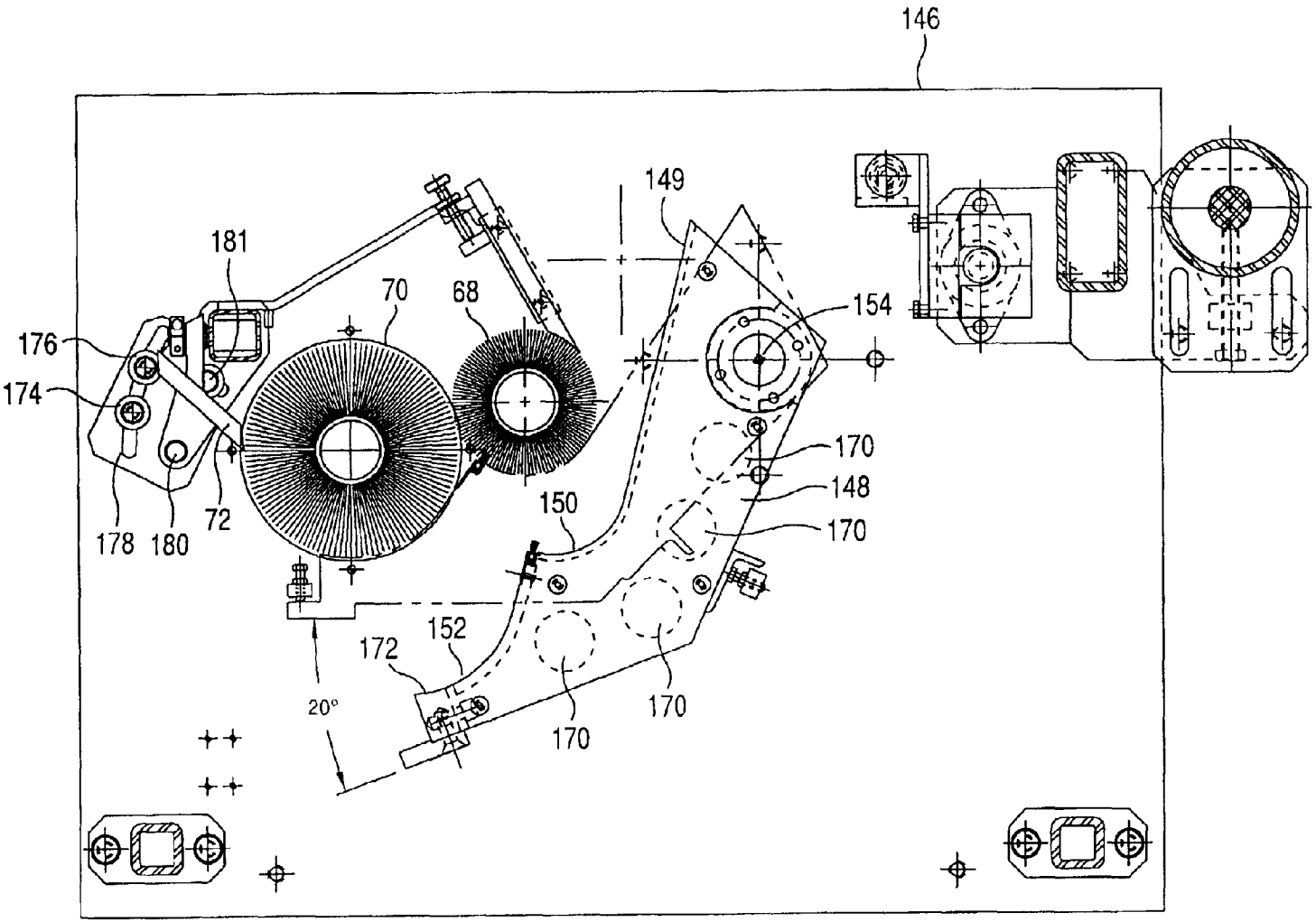
FIG. 9 is a cross-sectional view partially in elevation of the powder atomizer of FIG. 3.

The powder atomizing system of atomizer module A includes a first rotatable auger brush 64, as best shown in FIGS. 1 and 3, disposed below the outlet of hopper 20 for receiving powder, and for communicating the powder across the powder receptacle 66. A feeder or metering brush 68 withdraws the powder from receptacle 66 through an outlet 67 extending along the lower portion thereof, as best shown in FIGS. 1 and 9. See also U.S. Pat. No. 6,109,481, the assignee of which is the assignee hereof, and the disclosure of which is incorporated herein by reference. High speed atomizing brush 70 interacts with feeder brush 68 in order to receive the powder, and to atomize the powder so that it may be dispersed as a cloud and enter electrostatic coating module E. Preferably, a wing 72 is adjacent and cooperates with high-speed brush 70, in order to more accurately direct the cloud of powder particulate material into the interior of the electrostatic coating module E. See also U.S. Pat. No. 5,996,855, the assignee of which is the assignee hereof, and the disclosure of which is incorporated herein by reference.

As best shown in FIG. 3, auger brush 64 has a first portion that extends through the opening 74 of hopper 20. The brush 64 extends laterally across atomizer module A, between spaced sidewalls 76 and 78, along the open top of receptacle 66. Tubes 80 and 82 circumscribe brush 64 and are mounted for extension and retraction from walls 76 and 78, respectively, in order to permit adjustment of the effective width of receptacle 66. In this way, movement of the tubes 80 and 82 and the depending sidewalls extending into receptacle 66 permits adjustment of the effective width of atomizer module A, thus permitting substrate of different widths to be coated.

The walls 76 and 78 are displaced by rotation of shafts 330 and 332 in response to rotation of servomotors 334 and 336, respectively. Operation of the motors 334 and 336 thus permits the walls 76 and 78, and thereby their attached tubes 80 and 82, to be selectively positioned within receptacle 66 in order to set the effective width of receptacle 66. The walls 76 and 78 are secure cy clamps 338 and 340, respectively, to nuts 342 and 344, respectively, which are driven by the shafts 330 and 332.

Figure 4:
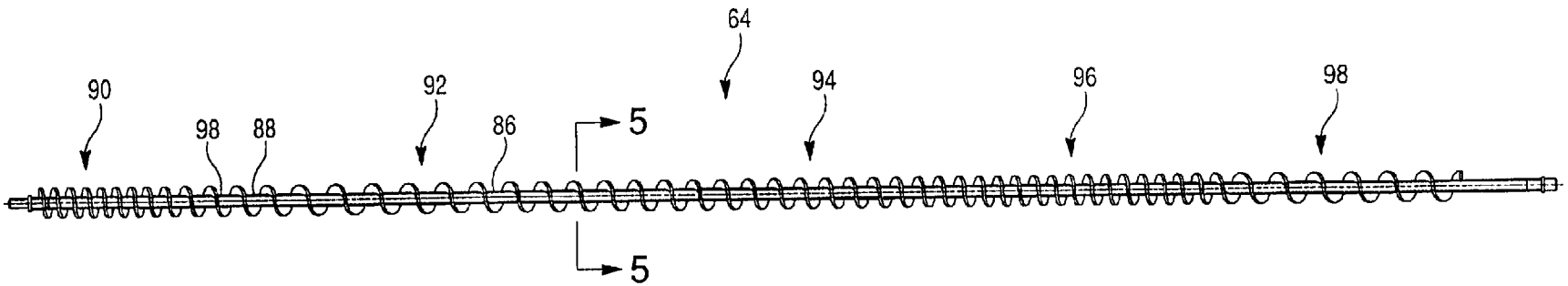
FIG. 4 is an elevational view of a powder supply auger brush according to the invention.
Figure 5:
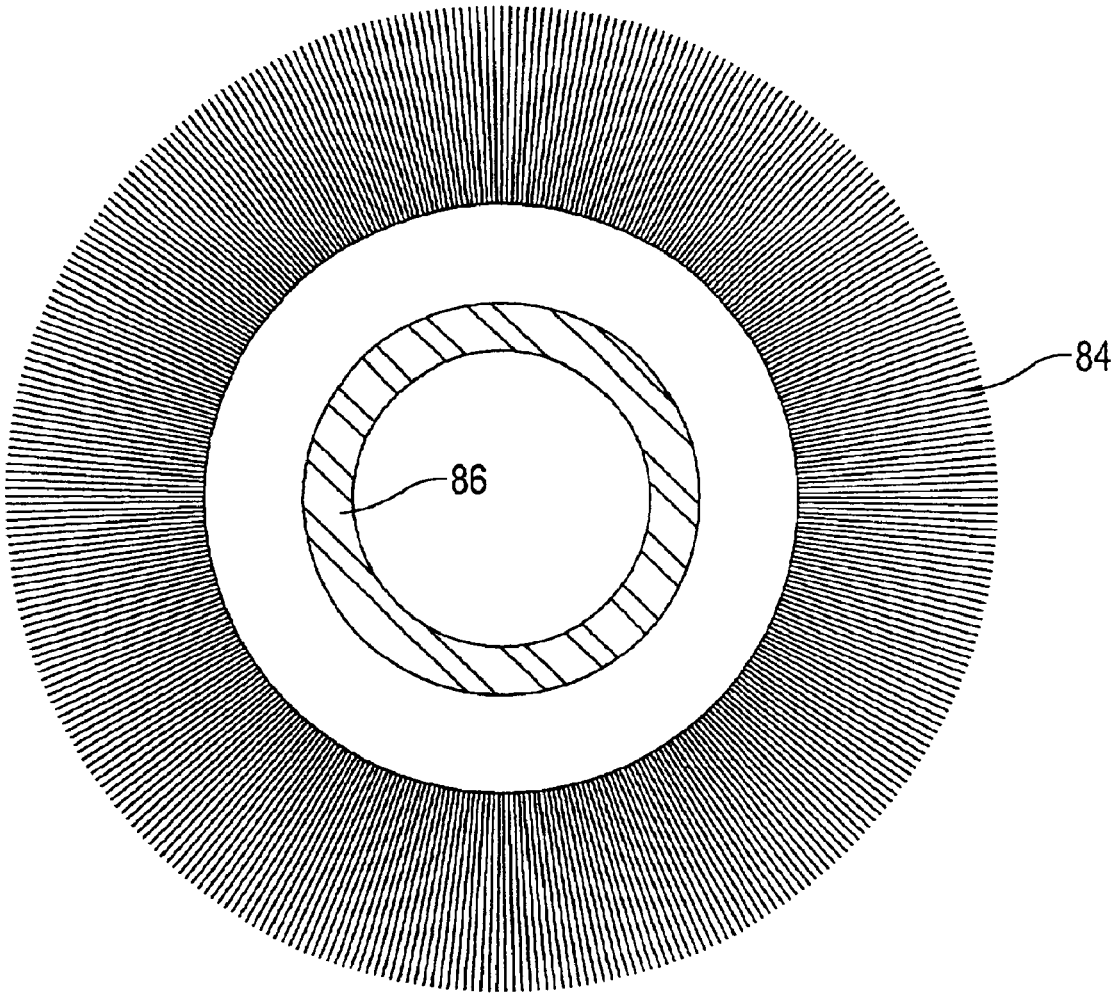
FIG. 5 is a cross-sectional view taken along the line 5—5 of FIG. 4 and viewed in the direction of the arrows.
Figure 10:
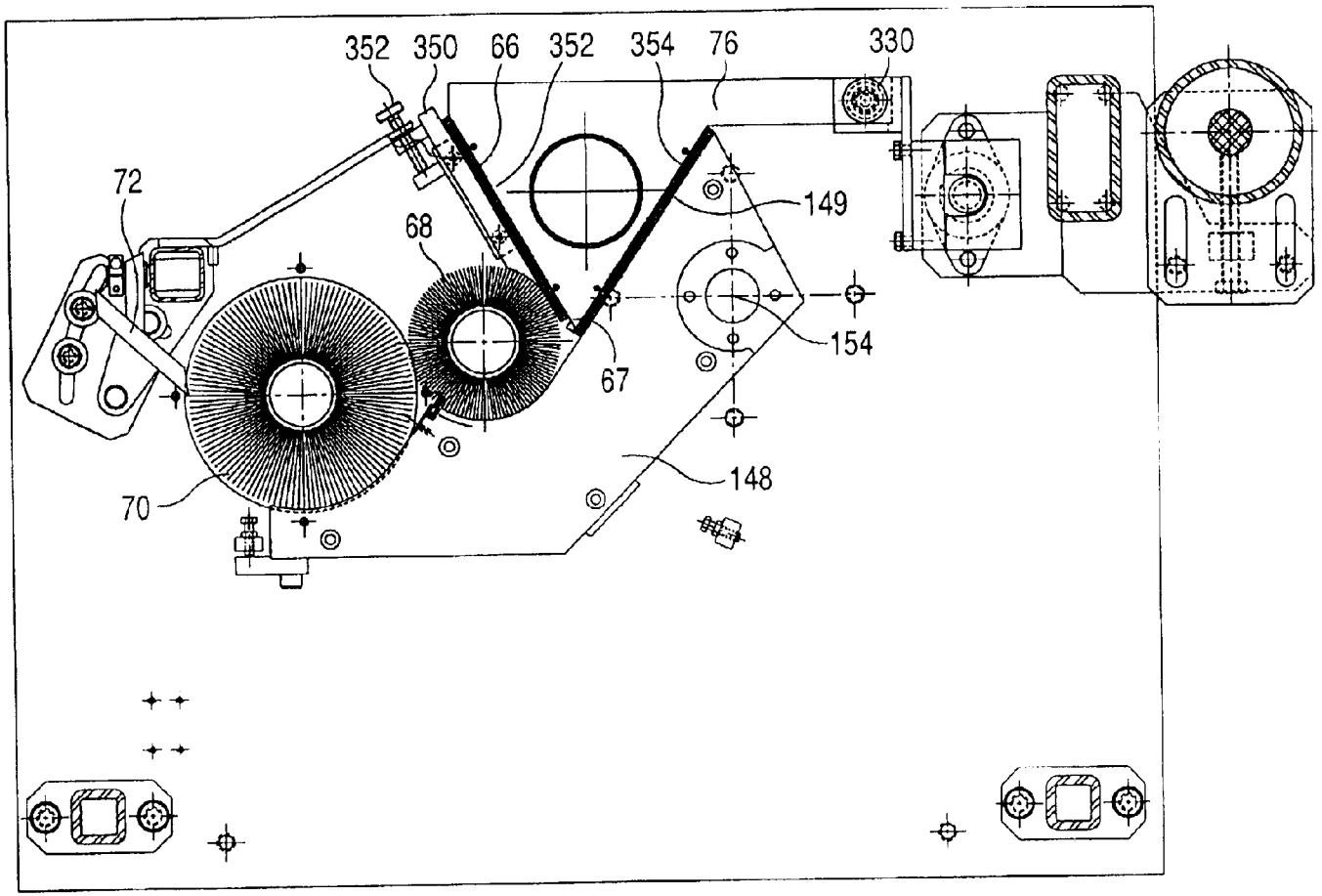
FIG. 10 is a cross-sectional view partially in elevation of the powder atomizer of FIG. 3 in the operational position.

The receptacle 66, as best shown in FIG. 10, is triangular in cross section with an open top and a bottom outlet 67 proximate feeder brush 68. Rotation of feeder brush 68 causes essentially uniform removal of powder from the receptacle 66 over its length. We have found that the pitch of the bristles 84, as best shown in FIGS. 4 and 5, should be varied in order to assure an essentially uniform level of powder within receptacle 66. For a brush of constant pitch, there may not be sufficient powder in the receptacle 66 towards end wall 68. This is because uniform removal across the length of receptacle 66 by feeder brush 68 requires uniform replacement of powder by auger brush 64. We have surprisingly found that uniformly decreasing the pitch from one flight of bristles to the next has the effect of assuring sufficient powder over the entire length of the receptacle 66. We have found that decreasing the pitch by approximately 1/16 of an inch per flight assures sufficient powder for a receptacle having a width of 108 inches.

As best shown in FIG. 4, brush 64 has the bristles 84 helically arrayed about shaft 86 between its opposed ends, and are secured to the shaft 84 by steel banding or the like. The helix creates a series of gaps 88, in which the powder is received and transported by rotation of shaft 86 by a suitable motor. The gaps 88 have bristles 84 at opposite ends thereof, with the spacing between the bristles 84 as defined by the gaps 88, thus defining a pitch. We have found that the brush 64 should have a first pitch 90 in the area underlying the opening 74 in hopper 20, a second pitch 92 extending through tube 80, and a constantly decreasing pitch portion 94. A fourth pitch portion 96 is provided for tube 82, with a final pitch 98 for transporting any powder not deposited into the receptacle 66 into a recycle line. The bristles 84 preferably are 6,6 nylon.

The variable pitch cross-feed auger 64 is used to uniformly convey powder paint from the hopper discharge opening 74 across the length of the receptacle 66. The receptacle 66 is used to supply powder to the metering brush 68. The receptacle 66 is open at the bottom. The metering brush 68 protrudes slightly into the opening. The opening 67 in the bottom of the receptacle allows powder to fill the bristles of the brush 68 by gravity. The powder is removed from the receptacle 66 at a steady rate along the entire exposed or effective length of the auger brush 64 by the underlying feeder brush 68. Each end of the auger brush 64 is partially blocked by the edge-guide tubes 80 and 82. The amount of blockage provided by tubes 80 and 82 varies, depending on the width adjustments made for coating various strip widths.

A benefit of the variable pitch auger brush 64 is the ability to keep a relatively uniform level of powder throughout the entire operating length of the receptacle 66. Keeping a uniform level of powder prevents starvation from occurring. Starvation occurs when the metering brush 68 does not receive an adequate supply of powder from the receptacle 66. Starvation of the metering brush 68 results in a thin coating of powder on the strip.

The powder in the receptacle 66 is being uniformly extracted while at the same time the auger brush 64 is advancing additional powder from the hopper 20. A unit volume of powder being advanced across the receptacle 66 is continuously subjected to the extraction of powder by the metering brush 68. The unit volume of powder will be greatly diminished or totally consumed if it is advanced at a uniform rate. The varying pitch in the flights of the auger brush 64 gradually slow the advancement of the powder as it moves across the receptacle 66.

The auger brush 64 flights start at a 3" pitch and incrementally get tighter by 1/16" each flight until a final pitch of 1½" is achieved. The greater pitch at the start advances the powder relatively rapidly. The advancement of powder gradually slows down with each successive pitch. The rapid advancement of powder at the start does not allow the metering brush 68 to extract significant volume, resulting in more powder collecting at the far end of the receptacle 66. In effect, the advancing powder is gradually stalled along the length of the auger brush 64.

The flights at the end of the auger brush 64 are designed to allow some overflow out of the receptacle 66. The overflow amount will vary as a function of the auger speed and metering brush speed. These speeds are set by the coating requirements for various strip widths, coating thicknesses and line speeds. Overflow prevents the powder from packing at the tighter flight pitches. Overflow also allows the auger brush 64 to work well for a range of powder volume requirements.

Figure 6:
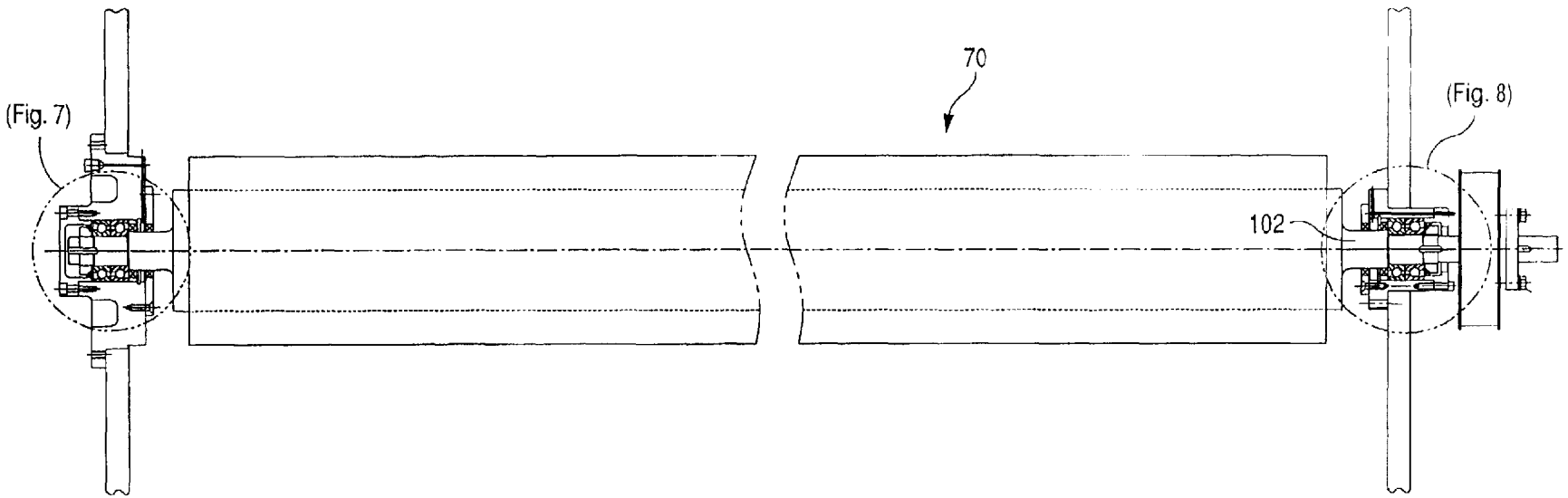
FIG. 6 is a fragmentary plan view, with portions shown in section, of a high-speed brush used with the powder atomizer of FIG. 3.

Brush 70 rotates rapidly in order to atomize the powder and permit it to be communicated into electrostatic coating module E in cooperation with wing 72. The powder deposition rate onto the substrate is a function of the speed at which the substrate moves through the electrostatic coating module E and the rate at which powder is communicated into the electrostatic coating module for being electrostatically applied onto the substrate. Because the brush 70 can have a length in excess of 108 inches, then high-speed rotation, which is a speed sufficient to atomize the powder and cause the particles to be centrifugally thrown from the bristles, may cause vibration of the brush 70. The brush 70, as best shown in FIG. 6, also has 6,6 nylon bristles 100 extending outwardly from shaft 102. We have found that radial support bearings permit the shaft 102 to vibrate excessively at or below the operational speed of rotation of the brush 70. The excessive vibration can damage the atomizer module A, delay operation of the powder application system PC, and disrupt the smooth transfer and communication of powder between hopper 20 and the electrostatic coating module E. We have found that providing angular contact bearings at the spaced opposite ends of shaft 102 avoids the vibration problems and permits deflection of the shaft 102, as sometimes occurs, to be easily accommodated without damage to the equipment. Angular contact bearings are considered both thrust and radial bearings. They preferably are arranged in a dual back-to-back orientation.

Figure 7:
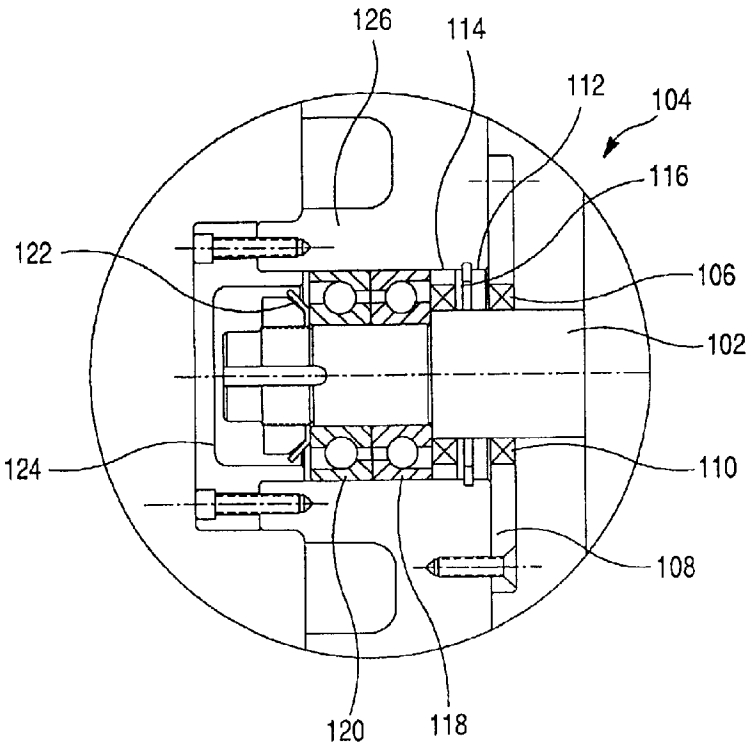
FIG. 7 is an enlarged cross-sectional view illustrating a bearing assembly at one end of the high-speed brush of FIG. 6.

As best shown in FIG. 7, end 104 of shaft 102 extends through opening 106 in sidewall 108 of atomizer module A. We provide a resilient seal 110 within opening 106 to minimize powder that might otherwise flow through the gap created between shaft 102 and opening 106. A retaining ring 112 is positioned adjacent spacer 114 having another resilient seal 116. A first angular contact bearing 118 and a second angular contact bearing 120 are mounted about reduced diameter portion of end 104 for facilitating free rotation of shaft 102 by a suitable motor. A lock washer 122 secures the bearings 118 and 120 about the shaft 102. We provide a cap 124 for sealing the bearing housing 126, and thus assure that powder will not be withdrawn. The seals 110 and 116 provide double protection against powder flowing inwardly or contaminating the bearings.

Figure 8:
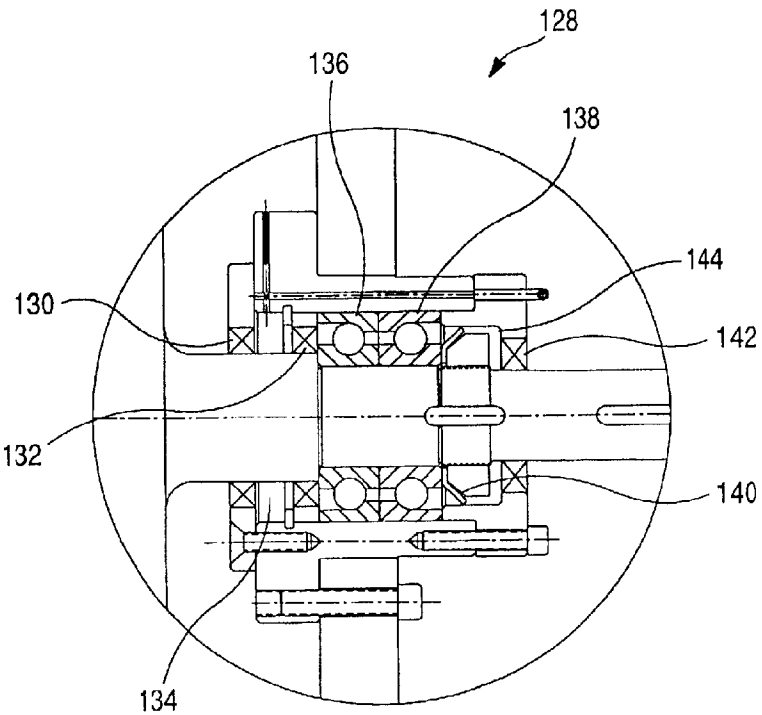
FIG. 8 is an enlarged cross-sectional view illustrating another bearing assembly used with the high-speed brush of FIG. 6.

End 128 of shaft 102, as best shown in FIG. 8, is operably connected to a suitable motor or the like for causing rotation of shaft 102. As with end 104, we provide seals 130 and 132 on either side of spacer 134 in order to prevent powder and/or contaminant flow. Angular contact bearing assemblies 136 and 138 are mounted to reduced diameter portion of end 128 adjacent lock washer 140. Yet another seal 142 is provided adjacent lock nut 144. The angular contact bearing assemblies 136 and 138 and 118 and 120 permit the brush 70 to be rotated at a very high speed, while avoiding vibration and permitting shaft deflection as might occur.

The atomizing brush 70 assembly and metering brush 68 assembly have the same bearing and seal arrangement. The atomizing brush 70 is a fast rotating 6¼" diameter brush and the metering brush 68 is a relatively slow rotating 4½" diameter brush. The atomizing brush 70 and its bearing system avoid resonant vibration. Resonant vibration occurs when the rotating speed of the brush matches the critical speed. The critical speed is the same as the natural frequency or the speed at which the rotating assembly will naturally vibrate. The critical speed of a rotating assembly is dependent on the span, stiffness, mass, and the rigidity of the end (bearing assembly) constraints.

Prior art powder application systems had a 4¼" diameter atomizing brush which had a carbon fiber wound core. The increased stiffness and reduced weight of the carbon core tended to reduce the actual critical speed. The actual critical speed occurred at about 2,500 rpm, which was less than the typical operating speed of 3,500 rpm. The rotating atomizing brush had to pass through the critical speed each time the coater was started for production. The entire powder-coating machine shook from the vibration. The bearing arrangement at each end of the shaft was a single-row radial ball bearing. The small diameter carbon fiber core of the brush and the non-rigid bearing design contributed to reducing the critical speed.

The brush 70 diameter preferably is 6¼". The carbon fiber core diameter of the atomizing brush 70 preferably is 4", resulting in a stiffer brush core. The bearing design has dual "back-to-back" mounting of angular contact bearings. The "back-to-back" mounting provides more rigid constraints at each end of the shaft, and results in less radial deflection. The actual critical speed is about 7,500 rpm. The atomizing brush 70 has an operating speed range of 2,000 to 2,400 rpm. The critical speed is thus higher than the operating speed by a factor of three. The atomizing brush 70 cannot reach the critical speed and therefore does not experience the detrimental effects of resonant vibration.

The "back-to-back" mounting configuration of the angular contact bearing assemblies is the same at each end of both the atomizing brush 70 and metering brush 68. The inner races are locked against a shoulder on the shaft and are held securely in place with a bearing lock-washer and nut. The width of the inner race is ground slightly thinner on each bearing to create a pre-load when configured in the "back-to-back" arrangement. This results in stiffer bearing constraints.

Each angular contact bearing set is protected from paint powder with either a totally enclosed cover or dual-lip contact seals. The outer angular contact bearings of the non-driven ends are protected with enclosed covers. The outer angular contact bearings of the driven ends are protected with single dual-lip contact seals mounted in covers. Both inside angular contact bearings, non-driven end and driven end, are protected with double dual-lip contact seals. The inner dual-lip contact seals are pressed into the bores of ground steel spacer rings. The outer dual-lip contact seals are mounted in covers. The angular contact bearing assembly on the driven end of each shaft is held rigidly to the bearing housing. The angular contact bearing assembly on the non-driven end of each shaft is allowed to float 1/16" in each direction with respect to the bearing housing. The 1/16" float in either direction allows for growth or shrinkage in shaft length due to thermal changes.

Brushes 70 and 68 extend between sidewalls 146 and 108, as best shown in FIGS. 6 and 9. Shoe 148 likewise extends between sidewalls 146 and 108 and cooperates with brushes 68 and 70 for causing the powder to be communicated from the receptacle 66. The shoe 148 has a linear wall 149 that receives one wall of receptacle 66, as best shown in FIG. 10. The shoe 148 has a first arcuate portion 150 and a second arcuate portion 152 depending therefrom, as best shown in FIG. 9. The arcuate portion 150 has a radius of curvature less than the radius of curvature of portion 152. The portions 150 and 152 extend along parallel, offset axes. Arcuate portion 150 conforms to the periphery of brush 68, in order to cause powder to be transported by rotation of the bristles of brush 68. Similarly, arcuate portion 152 has a contour conforming to the periphery of the bristles 84 of brush 70, for likewise causing the powder contained between the bristles to be transported by rotation of the bristles. Shoe 148 preferably has a plasma coating that allows powder to slide freely from metering brush 68 to atomizing brush 70.

Figure 19:
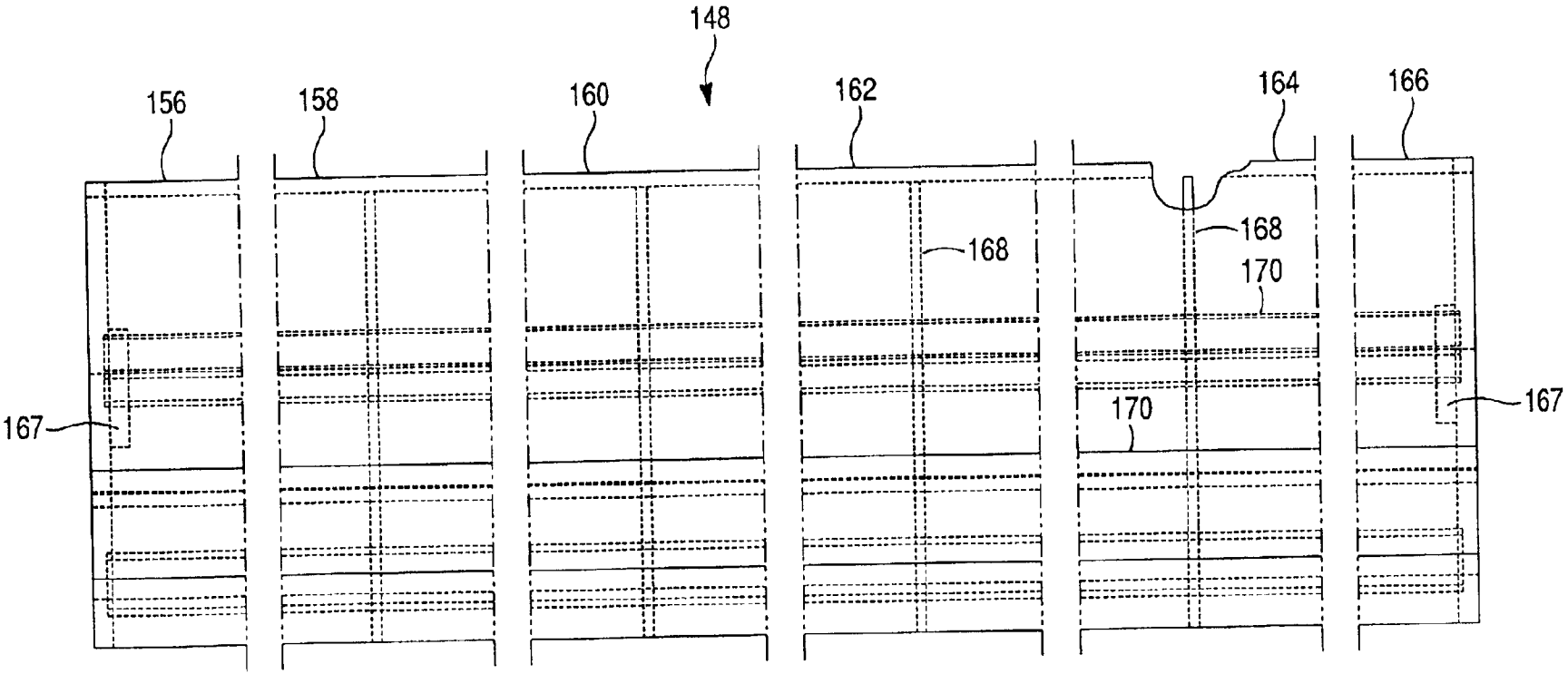
FIG. 19 is an exploded assembly drawing view of the one-piece weldment shoe of the invention.
Figure 19A:
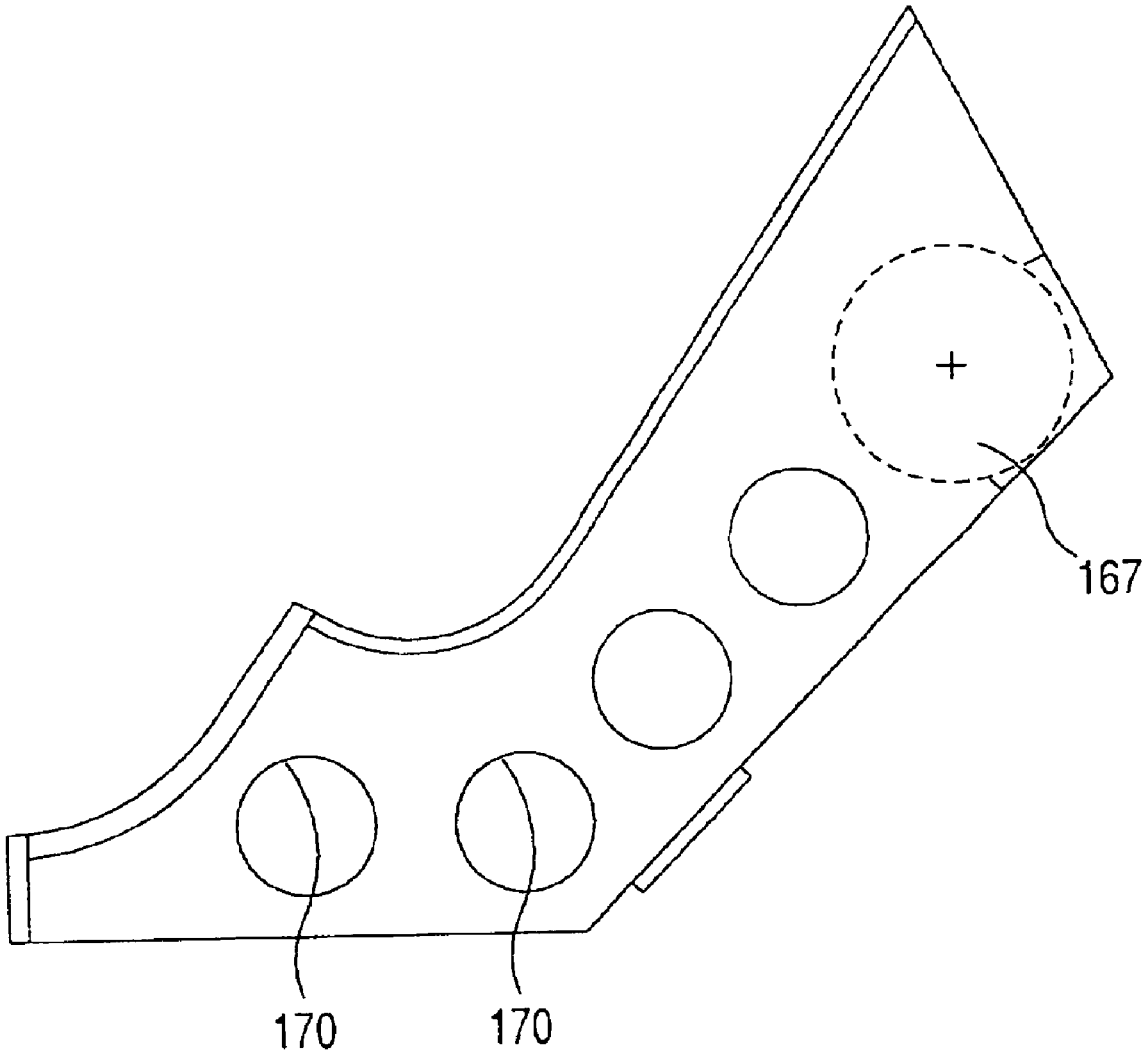
FIG. 19A is a side elevational view of the shoe of FIG. 19.

In the event that the type of powder being atomized changes, such as because the material or its color is changed, then the brushes 68 and 70 and the shoe 148 need to be cleaned in order to prevent contamination by subsequent operation of atomizer module A. We therefore provide shafts 154 upon which the shoe 148 is pivotally mounted. The shoe 148 may therefore be pivoted from the operational position of FIG. 10 to the cleaning or maintenance portion of FIG. 9. The shoe 148, as best shown in FIGS. 9, 10, and 19, is preferably a one-piece welded member in order to provide a structurally rigid integral assembly. The shoe 148 is formed from a series of appropriately contoured plates 156, 158, 160, 162, 164, and 166, as best shown in FIG. 19. Extending from each of the plates 156–166 is a centrally located rib 168 that provides rigidity to the plates 156–166. The ribs 168 may have one or more apertures 170, in order to minimize weight. The end plates 156 and 16 have bushings 167 for receiving shafts 154 extending from the sidewalls of atomizer module A.

The shoe 148 facilitates transport of the powder for ultimate communication to electrostatic coating module E. We have found that a non-conductive tip 172 is preferably positioned at the end or discharge portion of arcuate portion 152. The non-conductive tip 172 minimizes agglomeration of powder as might otherwise occur.

The one-piece weldment shoe 148 is designed to allow an operator to clean the double brushes in the atomizing modules A and A1 with ease. Prior art designs required an operator to remove each brush from the atomizing zone for cleaning. The constant removal of the brushes during each cleaning required the same equal man-hours to clean the brushes pneumatically. The one-piece weldment shoe, that pivots away from the double brushes 68 and 70, reduces cleaning man-hours.

Prior art shoe designs were comprised of segmented pieces held tightly together with contracted tie rods. The multiple pieces resulted in small steps or uneven surfaces between adjacent segments. The small steps caused uneven coating film thickness and difficulties with cleaning. The one-piece weldment shoe 148 has a continuous smooth plasma-coated surface throughout the entire brush contact area. The shoe 148 can pivot down away from the brushes 68 and 70. The pivoting feature allows the operator to have easy access to the brushes 68 and 70 for inspection or cleaning. The shoe pivoting action is accomplished with a pair of air-operated rotary actuators. The shoe 148 can be rotated back into the coating position by means of accurate mechanical stops. The shoe 148 increases the overall quality and functionality of the powder application systems PC and PC1.

In order to pivot shoe 148 from the orientation of FIG. 9 to the orientation of FIG. 10, then the sidewalls 76 and 78 need to be disengaged from nuts 342 and 344. This is because pivoting of shoe 148 would otherwise engage the sidewalls 76 and 78. It can be seen in FIG. 10 that the shoe surface 149 forms one wall of receptacle 66. The other or opposed wall is provided by plate 350 that is adjustably carried by bracket 352.we can adjust plate 350 in order to adjust opening 67, thereby providing more precise control over the discharge of powder from receptacle 66. Because the sidewall 76 and 76 and the plate 350 are made of aluminum, then we provide brushes 352 and 354at each of the endwalls 76 and 78 to prevent metal-to-metal contact between the endwalls 76 and 78 and shoe 148 and plate 350.

Figure 20:
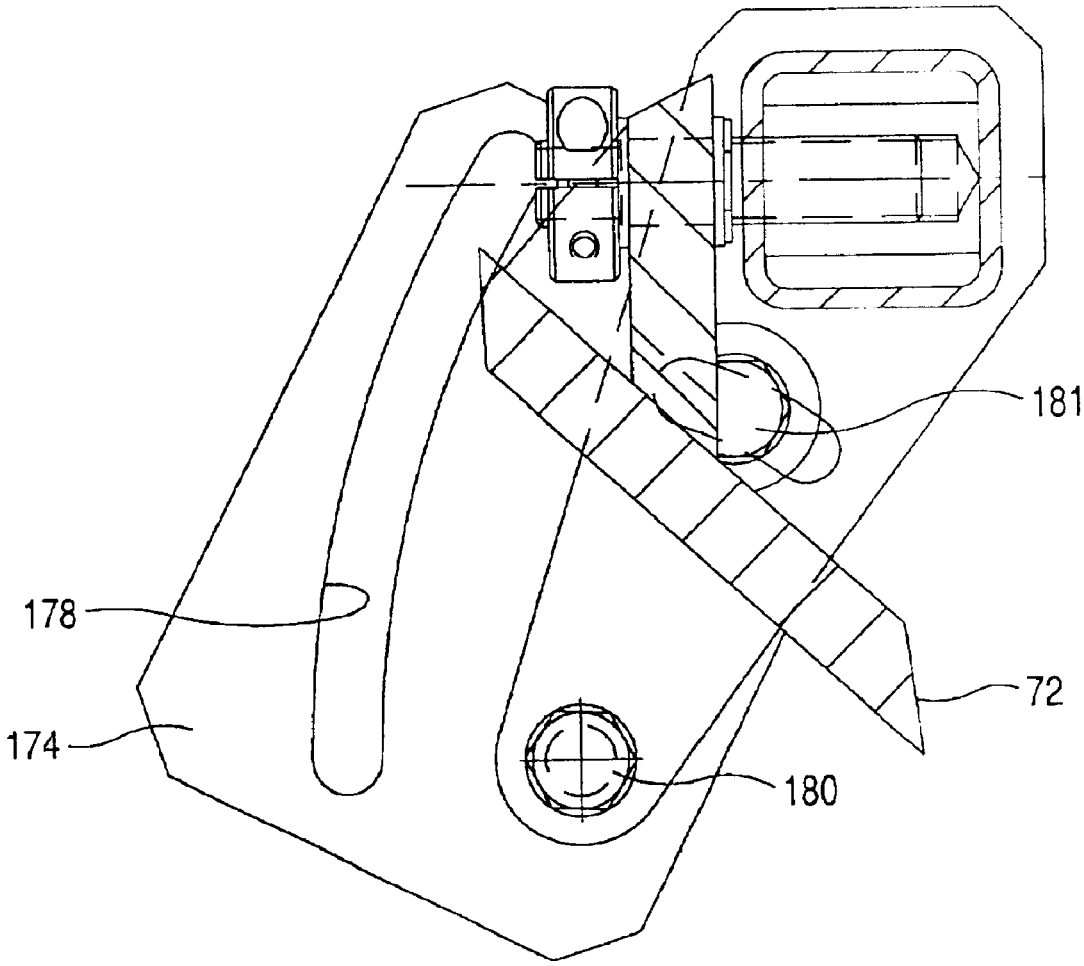
FIG. 20 is an elevational view, partially in section, illustrating the wing adjustment mechanism.

As noted, wing 72 is provided adjacent brush 70 for assisting in directing the atomized powder particulates toward electrostatic coating module E. We have found that it may sometimes be necessary or desirable to adjust the orientation of wing 72. For this reason, we provide a bracket 174, as best shown in FIGS. 9–10 and 20, to which the wing 72 is mounted through bosses 176. There is a bracket 174 at either sidewall of atomizer module A. Each of the brackets 174 has an arcuate slot 178 through which the bosses extend. Additionally, the bracket 174 may be pivoted about shaft 180. Pivoting of the bracket 174 and movement of the bosses 176 within slot 178 permits the orientation of wing 72 to be selectively adjusted. Additionally, wing 72 may pivot about shaft 181.

Figure 12:
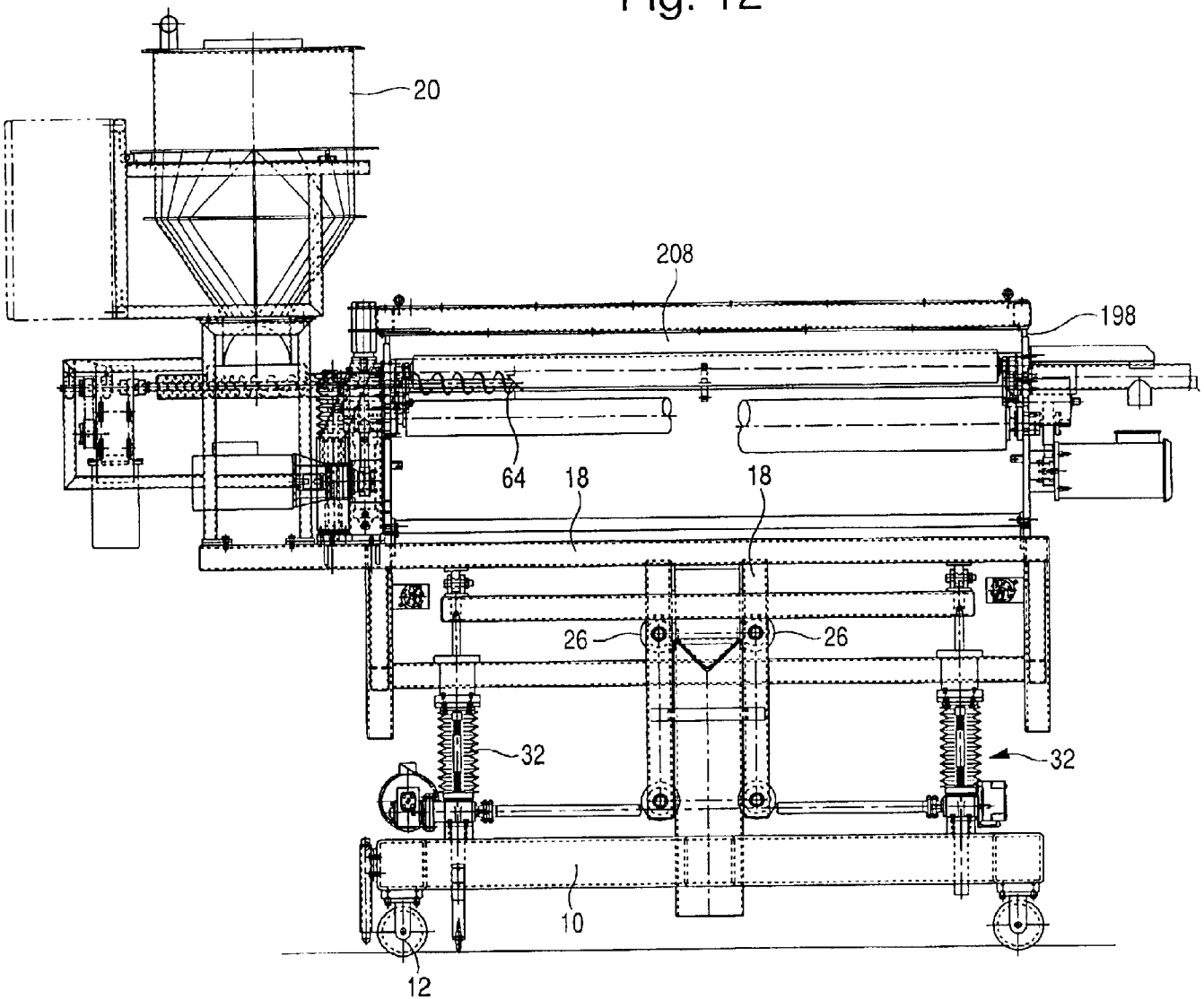
FIG. 12 is a fragmentary front elevational view of the powder application system of FIG. 2.
Figure 17:
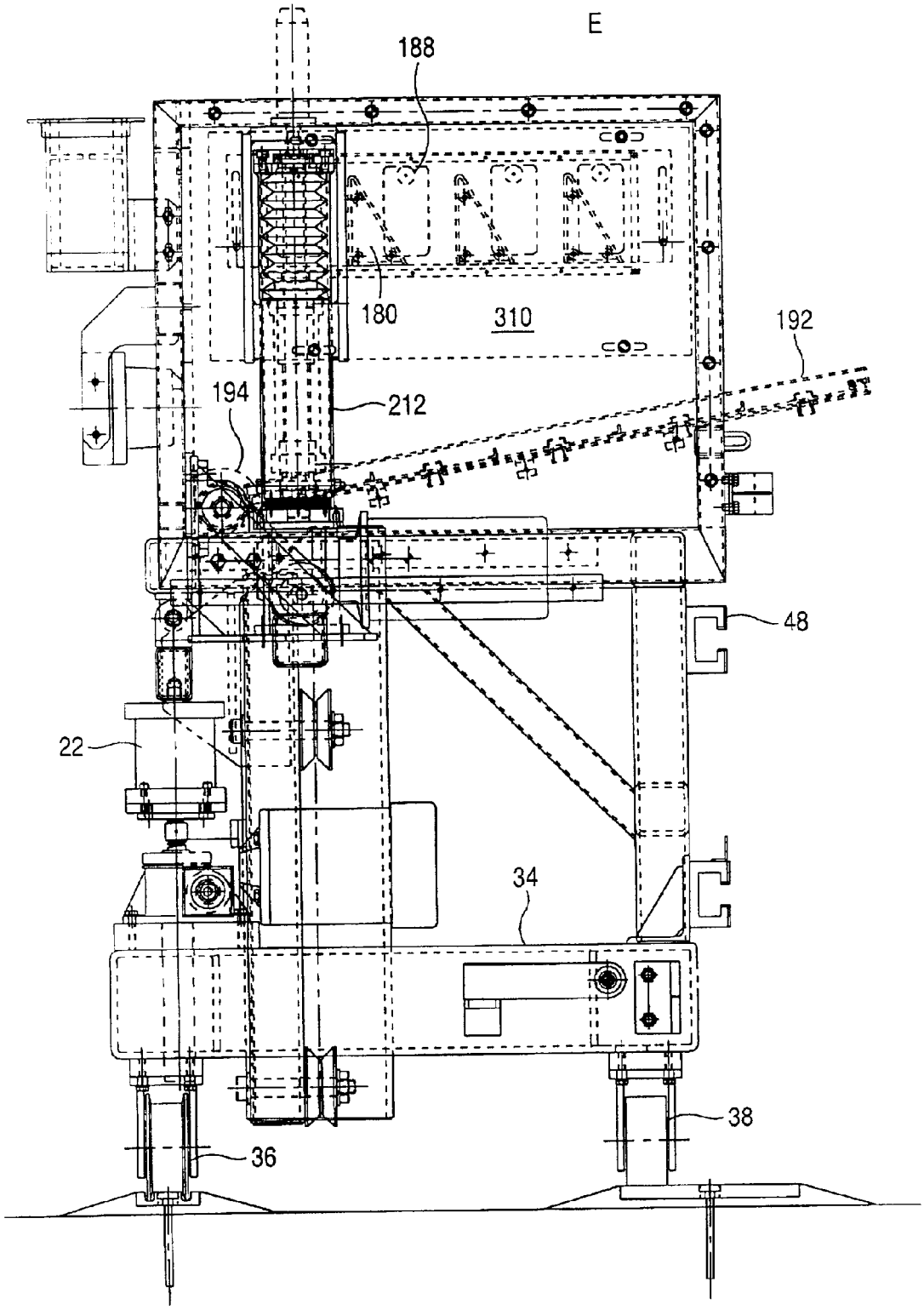
FIG. 17 is a side elevational view of the electrostatic coating module of FIG. 11 in the closed or operational position.
Figure 26:
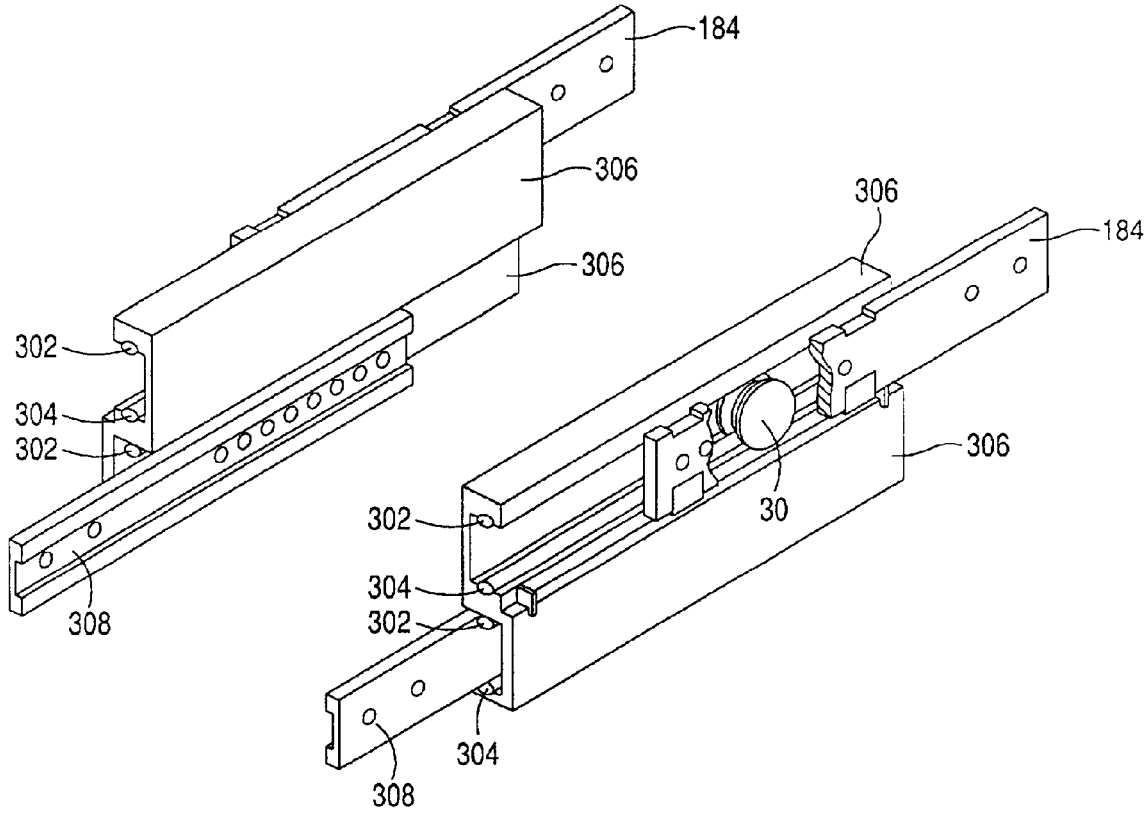
FIG. 26 is an enlarged fragmentary assembly drawing of the slider mechanism used for translating the electrostatic coating module between the positions of FIGS. 11 and 17.
Figure 27:
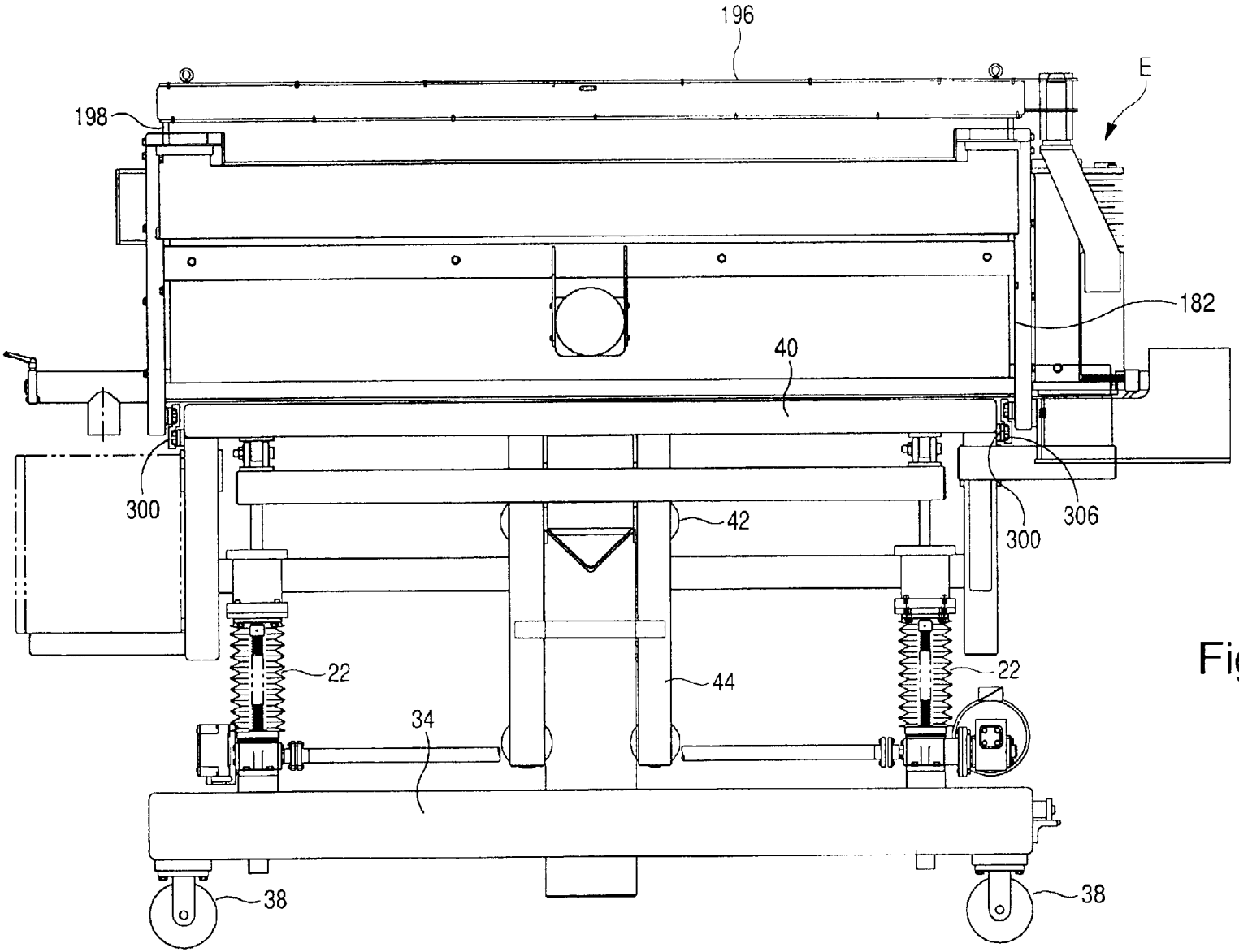
FIG. 27 is a front elevational view of the electrostatic coating module.

Electrostatic coating module E, as best shown in FIGS. 1 and 12, is rectangular in plan and elevation and has a frame 182 extending along the spaced lateral sides thereof. The frame 182 is secured to slider 184 that carries V-notch rollers 300, as best shown in FIG. 26. The rollers 300 contact hardened rods 302 and 304 extending along block 306. A similar block 306 having hardened rods 302 and 304 extends below and preferably is integral with the first mentioned or upper block 306. Slider 308, having like V-notch rollers 300 is secured to frame 40. The rollers 302 and sliders 184 and 308 permit the enclosure 310 of electrostatic coating module E to be shifted between the FIG. 11 position and that of FIG. 17.

The electrostatic coating module E of the powder application system PCo telescopes independently because of rollers 300. The telescopic electrostatic coating module E allows quick access by an operator to the electrostatic coating module E or the atomizer module A. The design allows the operator to avoid damage to the electrodes within the electrostatic coating module E during an operational adjustment to the atomizer module A.

The electrostatic enclosure 310 slides out 24" in the direction of strip travel by virtue of the rollers 300 and blocks 306. The enclosure 310 is mounted on the top rail of a three-rail telescopic slide provided by sliders 184 and 308 and integral blocks 306. The bottom rail is mounted to the rigid electrostatic zone base frame 40. There is a three-rail telescopic slide on each lateral side of the enclosure 310. The sliders use a v-shaped track rollers 300 that ride on hardened round rods 302 and 304. The v-shaped rollers 300 and rods 302 and 304 work well with powder coating machinery. The very high contact forces between the v-shaped rollers or wheels 300 and round rods 302 and 304 allow the sliders to remain free of packed powder. Prior art powder application systems allowed the atomizing zone to be removed in a traverse manner from the entire powder application system. This setup was complicated and cumbersome, due to the need to remove the atomizing zone from the actual powder application system. The configuration required an independent cart to be connected directly to the powder application system. The atomizing zone was removed from the powder application system and onto the cart. These additional steps added more work time for the operator to clean and maintain the entire powder application system. It did not allow quick or easy access to the electrostatic or atomizing zone.

Figure 21:
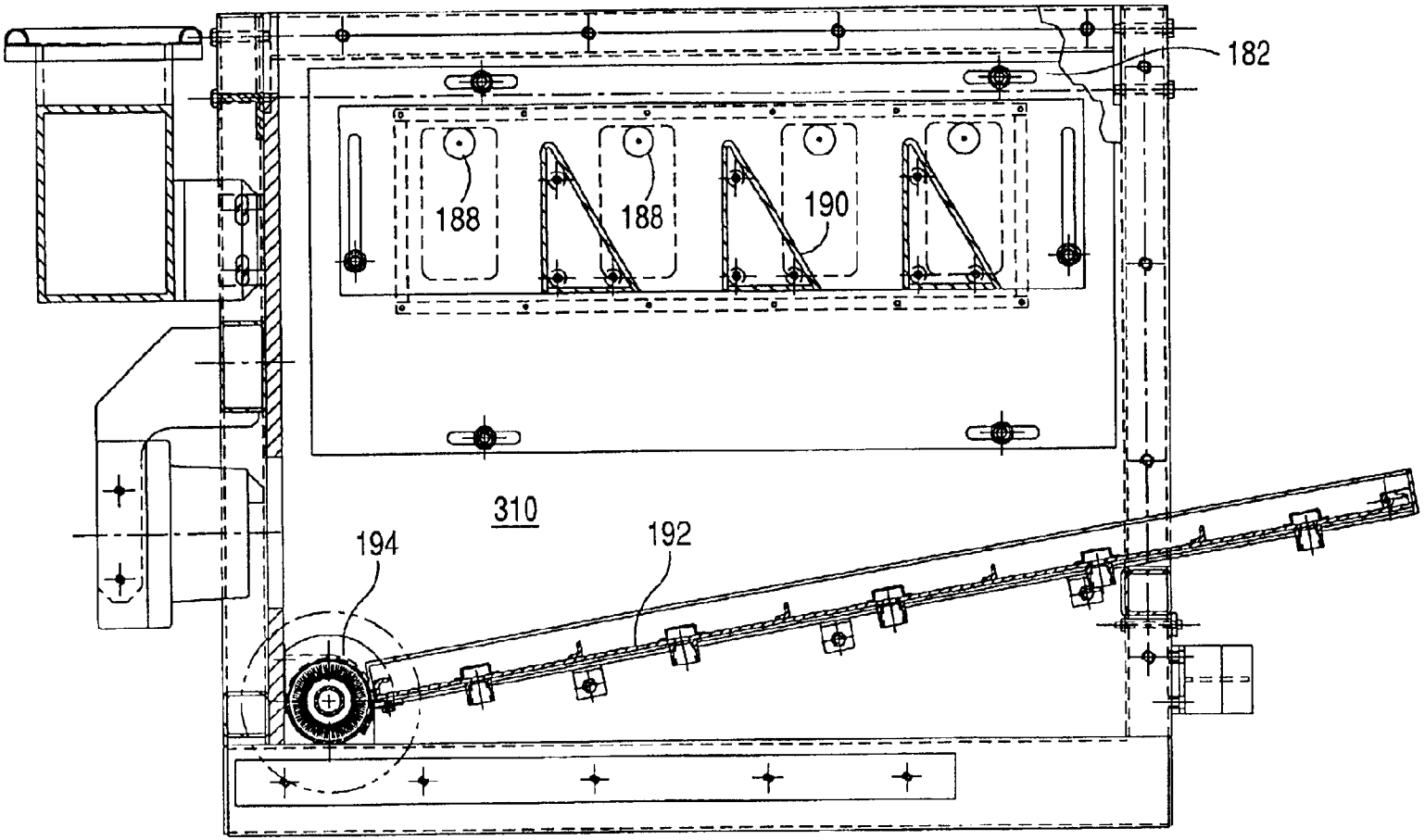
FIG. 21 is a fragmentary cross-sectional view of the electrostatic coating module illustrating the powder recycle mechanism.
Figure 25:
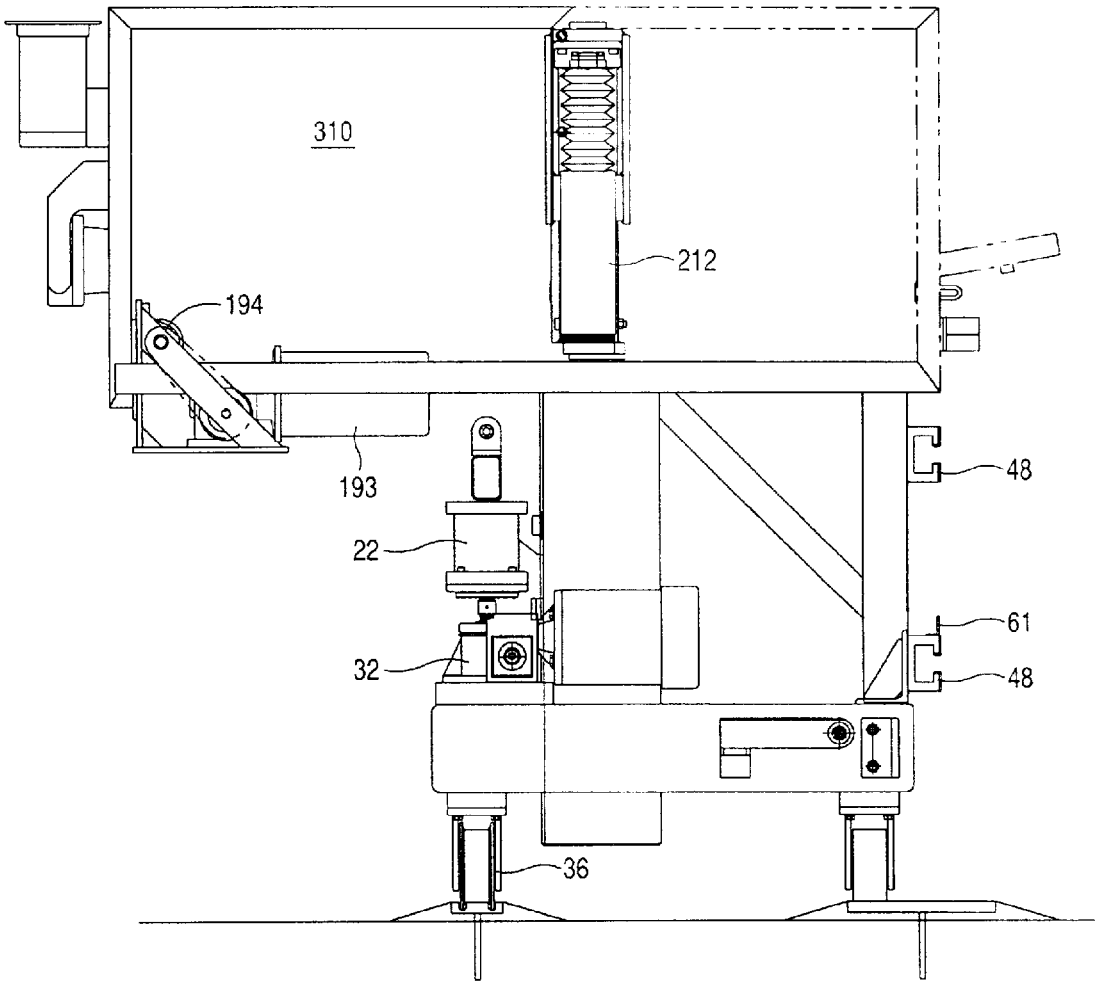
FIG. 25 is a side elevational view of FIG. 11 with portions removed in order to illustrate internal details.

As best shown in FIG. 21, we provide an avalanche 192 angularly disposed along the bottom of electrostatic coating module E. It can be seen from FIG. 1 that the avalanche 192 extends into atomizer module A. Rotating brush 194 is positioned at one end of avalanche 192 and causes powder falling on avalanche 192 to be transported to a recycle system (not shown). Brush 194 is rotated by motor 193, as best shown in FIG. 25, and is displaceable with enclosure 310. In this way, when the powder application system PC is in the operating position of FIG. 1, any powder discharged from atomizer module A into electrostatic coating module E that does not become electrostatically attached to substrate will ultimately fall onto avalanche 192 and be recycled through rotation of brush 194.

Figure 18:
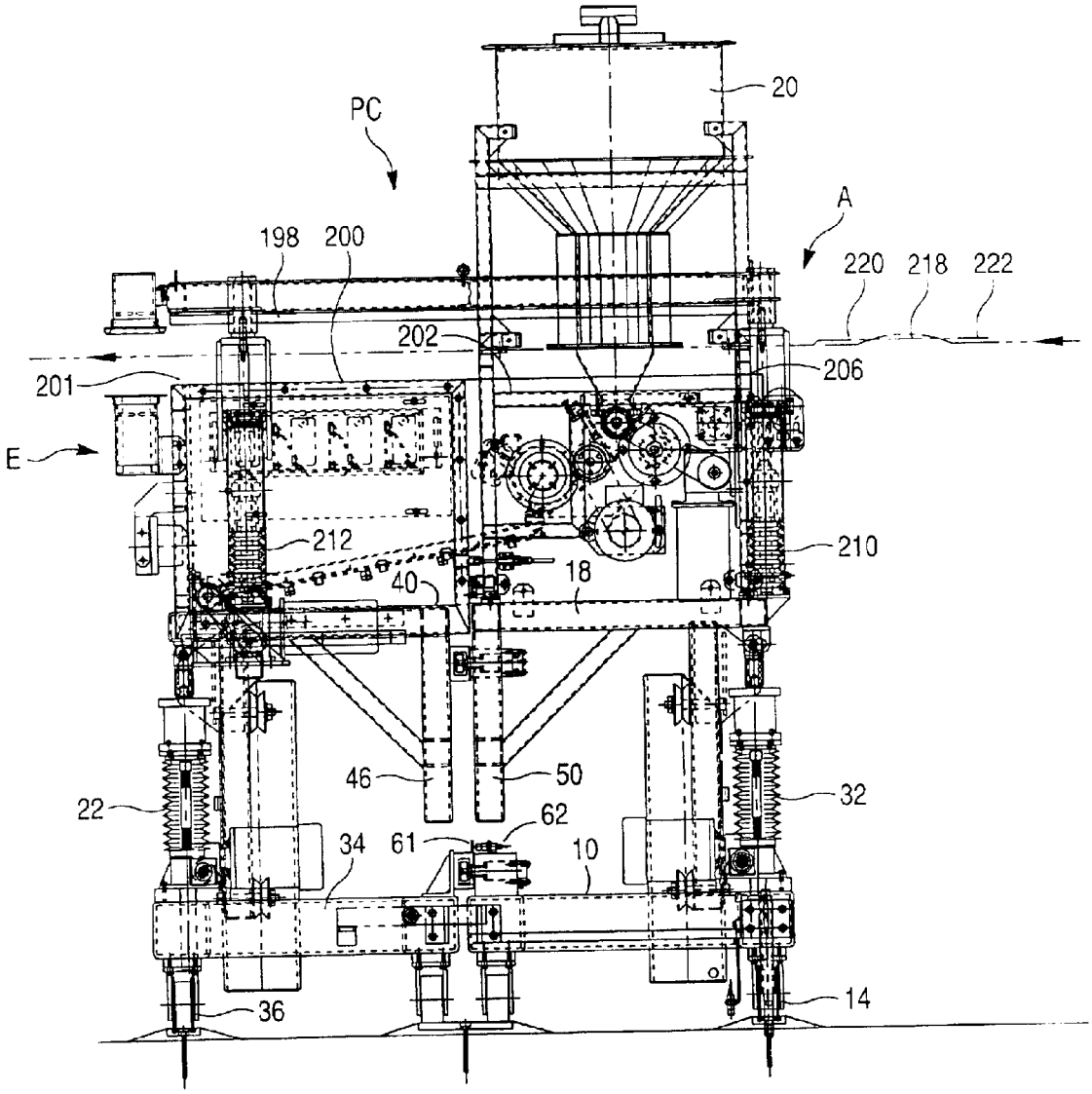
FIG. 18 is a side elevational view of the powder application system of FIG. 1 in the lowered orientation.

As best shown in FIGS. 1 and 18, a cover 196 extends above the open top of atomizer module A and electrostatic coating module E when the modules are in the secured together position. The cover 196 is rectangular in plan, and has resilient seals 198 extending along its spaced laterally extending lower edges. The seals 198 engage the upper surfaces 200 and 202 of atomizer module A and electrostatic coating module E, in order to form a seal therewith. The cover 196 and the transversely extending surfaces 204 and 206 form a gap 208, as best shown in FIG. 12, through which the substrate material, such as steel strip, is translated for coating. In the operating mode of FIGS. 1 and 12, the gap 208 is relatively small, in order to minimize leakage of powder, air entrainment, and the like which would reduce the efficiency of powder application.

Continuous movement of substrate through powder application system PC achieves maximum productivity of powder application system PC. When coating strip materials, such as steel strip, there occurs a need to join a tail end of one strip with the lead end of the next strip to be coated. In order to avoid the need and expense for accumulator towers and the like, as may be provided in steel mills and liquid coil coating lines, and in order to permit coating of strips of differing widths, then the tail end of one strip is typically stitched to the lead end of the next strip. Formation of the stitch causes a protrusion of sometimes as much as one inch from the joined strips. The gap 208 preferably is less than one inch, with the result that the presence of a stitch might damage the powder application system PC should it contact the cover 196 or the edge 206.

The powder application system PC allows the entry and exit openings to expand, permitting a moving strip stitch to pass through without damaging the chamber frame and structure. The powder application system PC retracts from a coating position to a stationary position automatically, without operator assistance. The purpose of automatic retraction is to allow a mechanical stitch, which joins the head and the tail of a continuous moving metal strip, to pass through the powder application system. A mechanical stitch can damage a powder application system severely because sections are fabricated from polycarbonate. When the powder application system retracts, a proximity switch located near the atomizer module A detects when the powder application system PC is in the open position. The proximity switch then sends a signal to a control module to shut down the electric current being supplied to the electrostatic coating module E.

Each module A and E is divided into upper and lower sections. The upper section or cover 196 retracts away from the lower section when a stitch passes. The lower section retracts away from the upper section when a stitch passes. Each section retracts a calculated distance, in order to allow the stitch 218 to pass, as best shown in FIG. 18. The distance is calculated in relationship to the catenary, the sag of the metal strip between two supports.

Prior art powder application systems required the operator to track the location of the stitch prior to its arrival. The operator then manually opened the powder application system to prevent the stitch from hitting the entrance opening, exit opening, and internal structure of the powder application system. The operator was also required to manually shut off the electrostatic zone electric current.

In order to prevent damage by the presence of a stitch, we provide pneumatic cylinder and piston assemblies 210 and 212, which are secured to the frames 18 and 40 respectively, and to the cover 196, on each lateral side thereof. The cylinder and piston assemblies 210 and 212 each have a cooperating piston which, when extended, cause the cover 196 to be lifted from the atomizer module A and the electrostatic coating module E, as best shown in FIG. 18. Because the stitch 218, as best shown in FIG. 18, extending from tail end 220 and lead end 222, may extend above and/or below the respective ends, then we also utilize the cylinder and piston assemblies 22 and 32 in order to lower the atomizer module A and electrostatic coating module E an amount sufficient to preclude the stitch 218 from engaging the surface 206. We have found that lifting the cover 196 a distance of 6 inches and lowering the modules A and E a distance of 4 inches results in a gap of 2 inches, which is sufficient to accommodate the stitch 218 without causing damage to the powder application system PC. After the stitch 218 has passed beyond the powder application system PC, then the cover 196 is lowered and the atomizer module A and electrostatic coating module E raised into the operating position of FIG. 1.

Figure 2:
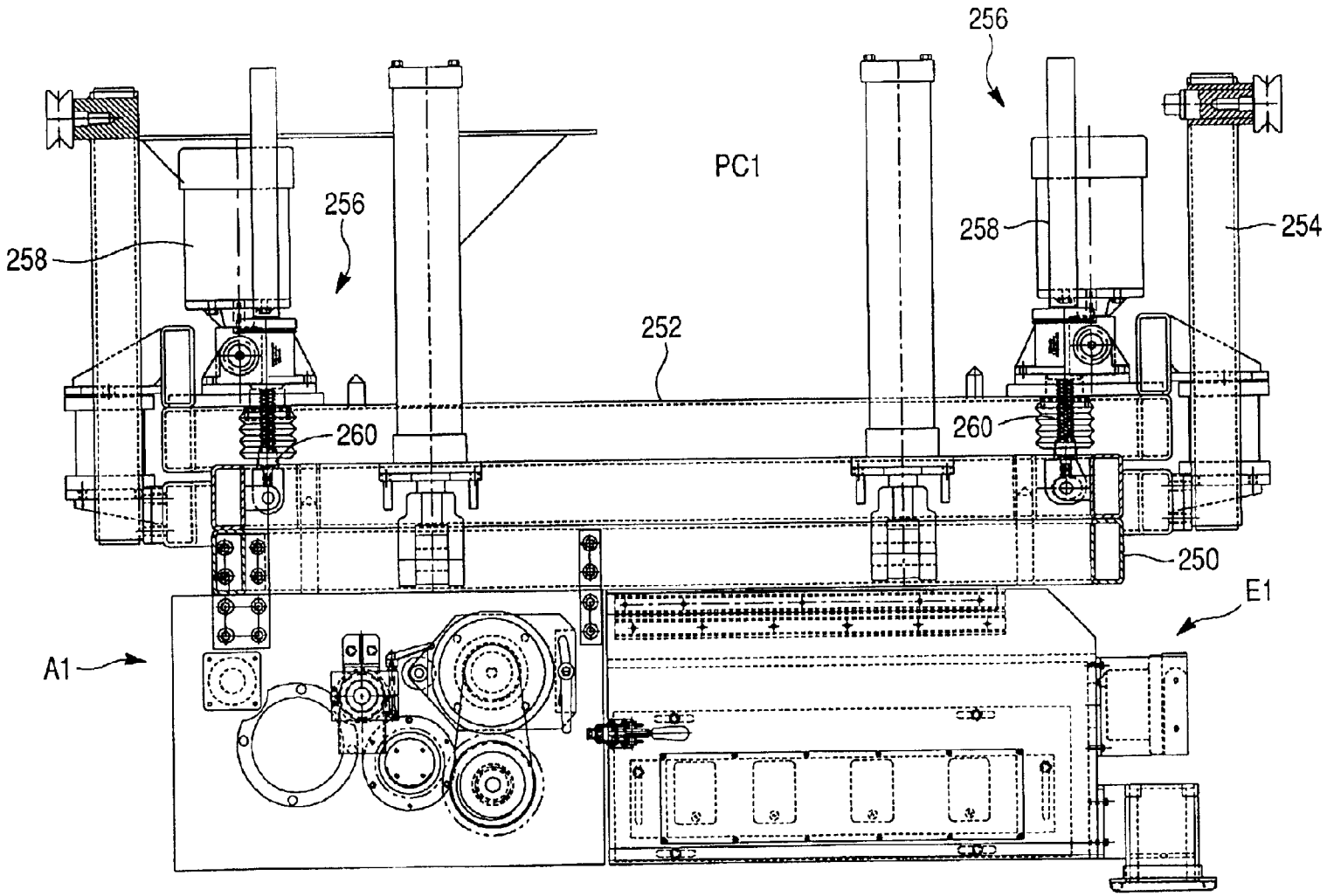
FIG. 2 is a side elevational view of a second embodiment of a modular powder application system.

The powder application system PC of FIG. 1 is adapted for coating one surface of the substrate. As illustrated in FIG. 1, the powder application system PC is intended for coating the lower surface of the strip because it is a floor mounted assembly. The powder application system PC1 of FIG. 2 is similar to the powder application system PC and has an atomizer module A1 and an electrostatic coating module E1. Unlike the powder application system PC of FIG. 1, however, powder application system PC1 is intended to be mounted to the roof or similar horizontal support of the coating line. In this regard, supports 224 and 226 are secured to the horizontal support 228. The rollers 230 receive corresponding angles 232 which extend transversely to the movement direction of the strip. Unlike the powder application system PC of FIG. 1, the V-rollers 230 permit movement of the powder application system PC1 and not the individual modules thereof. The supports 224 and 226 thus fix the position of the angles 232.

Disposed below the atomizer module A1 and the electrostatic coating module E1 is a recycle cart 234 that has an open top. Recycle cart 234 is moveable on rollers 236. An avalanche 238 is positioned within recycle cart 234 and communicates with rotating brush 240 in order to recycle powder which may fall into cart 234 from electrostatic coating module EC1. Cylinder and piston assemblies 242 extend between frame 244 and the hopper 246 of recycle cart 234. Actuation of the cylinder and piston assemblies 242 therefore permits the height of upper surface 248 of hopper 246 to be adjusted relative to strip 220, as best shown in FIG. 15.

Figure 15:
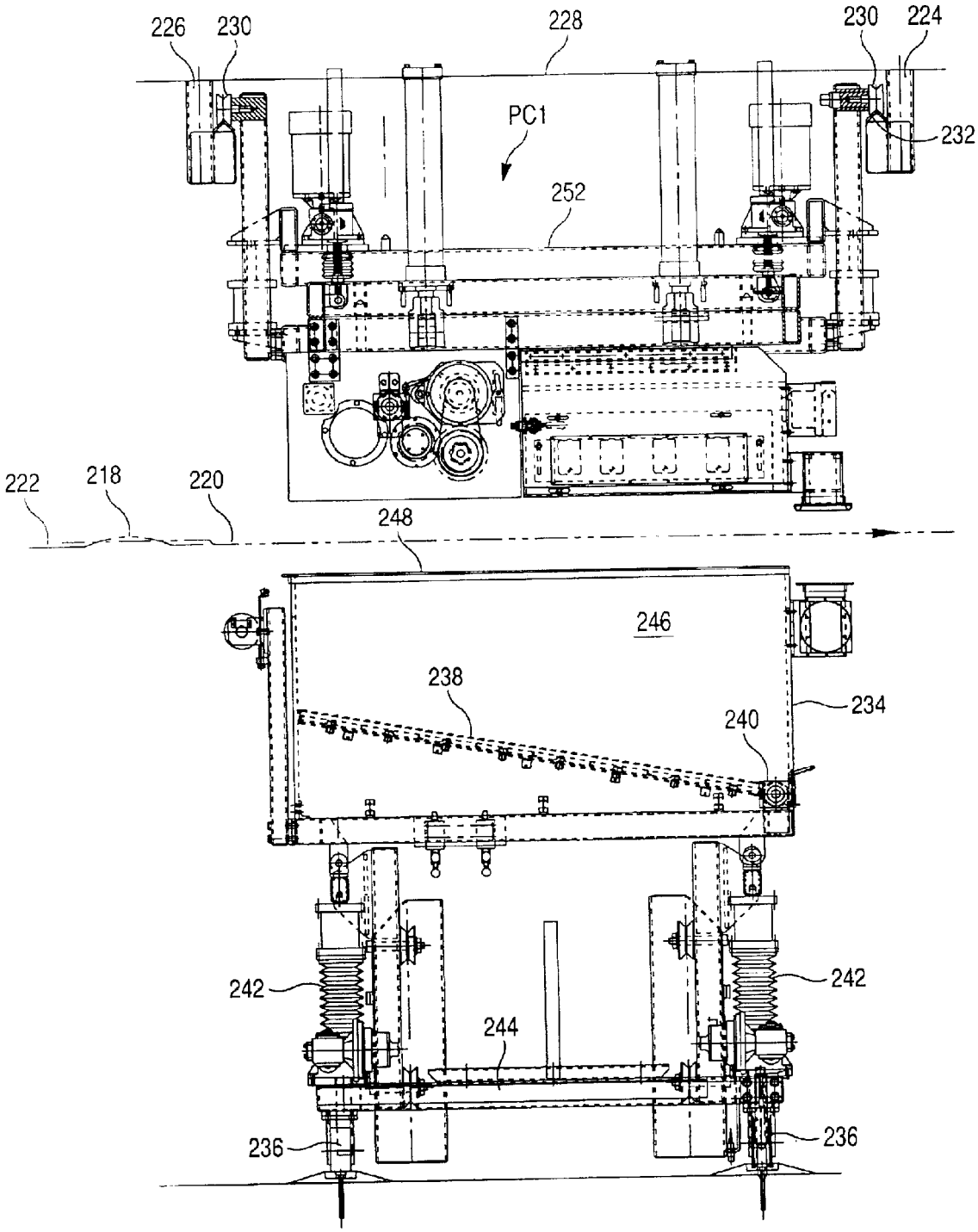
FIG. 15 is a side elevational view of the powder application system of FIG. 2 in a spaced orientation.
Figure 16:
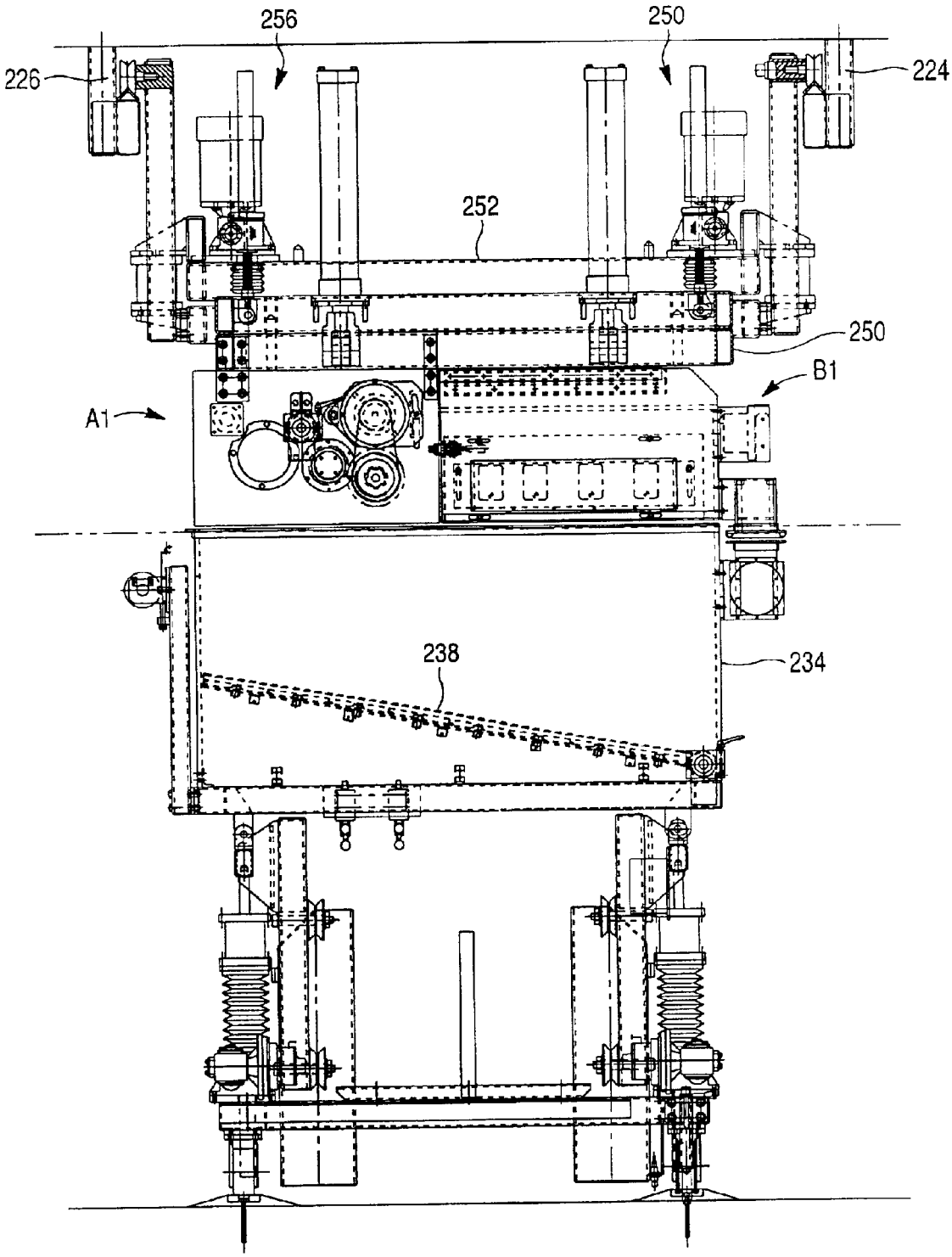
FIG. 16 is a side elevational view of the powder application system of FIG. 15 in the coating orientation.
Figure 24:
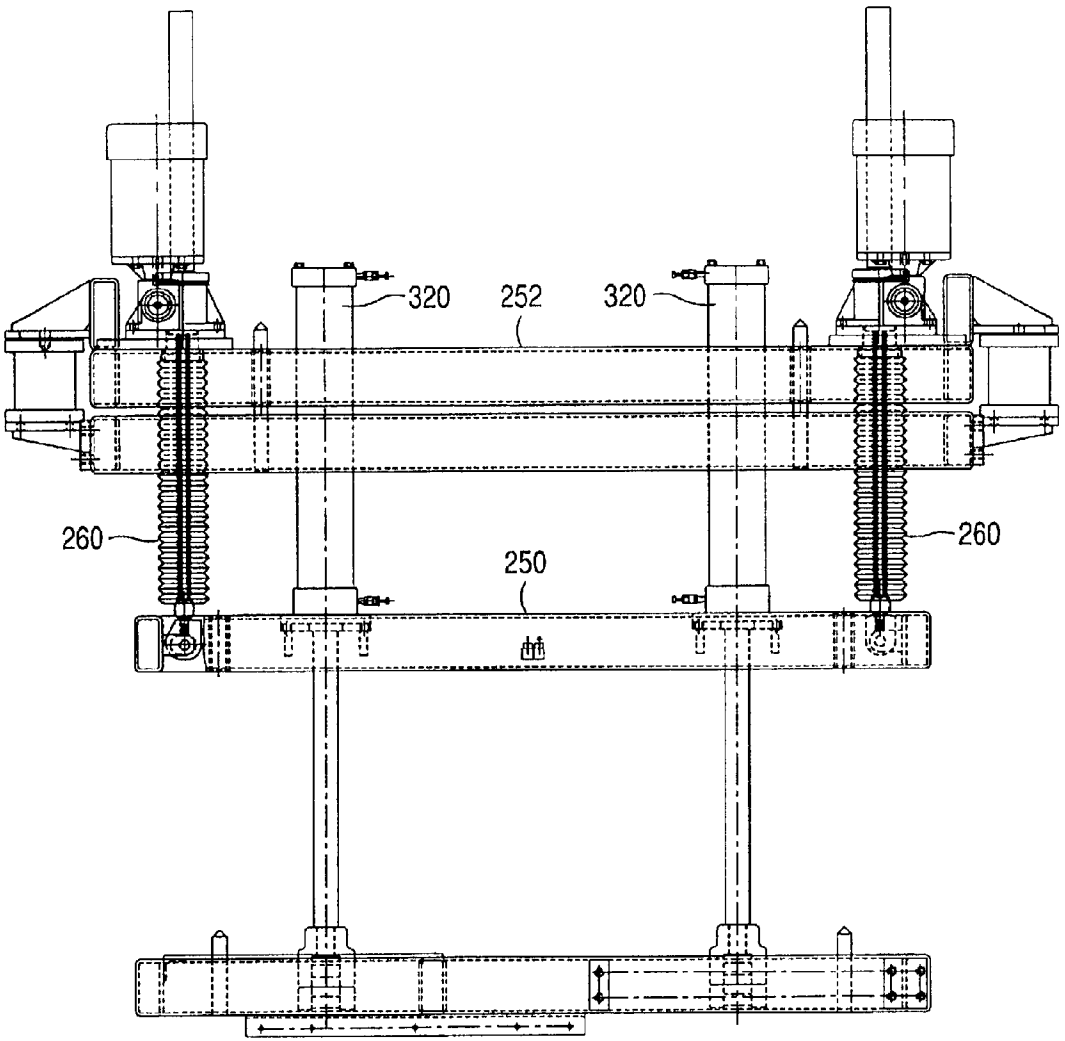
FIG. 24 is a fragmentary elevational view of the upper frame of the powder application system of FIG. 2.

Atomizer module A1 and electrostatic coating module E1 are secured to horizontally disposed frame 250, as best shown in FIGS. 2, 15 and 16. Upper frame 252 depends from supports 224 and 226 through braces 254. Thus, the position of upper frame 252 is fixed. Cylinder and piston assemblies 256 have the cylinders 258 thereof secured to upper frame 252 and the pistons 260 thereof operably secured to frame 250. Actuation of the cylinder and piston assemblies 256 causes displacement of the pistons 260, and thus movement of the frame 250 and hence of the atomizer module A1 and the electrostatic coating module E1. As with the powder application system PC, operation of the powder application system PC1 needs to take into account the presence of a stitch 218. For this reason, when a stitch is closely adjacent powder application system PC1, we retract the pistons 260 in order to raise the frame 250, as best shown in FIG. 15. Similarly, we retract the pistons of the cylinder and piston assemblies 242 in order to lower recycle cart 234. After the stitch 218 has passed, then the pistons 260 extend and lower the frame 250 and thus the atomizer module A1 and the electrostatic coating module E1. Correspondingly, the pistons of the cylinder and piston assemblies 242 extend and cause the recycle cart 234 to move to the operative position of FIG. 16. We also provide cylinder and piston assemblies 320, as best shown in FIG. 24, to permit the frame 250, and thus the modules A1 and E1, to be lowered to a service position, as shown in the dashed lines.

Preferably, a resilient seal extends along the laterally disposed upper surfaces 248 of the recycle cart 234 in order to provide sealing engagement with the atomizer module A1 and the electrostatic coating module E1 to eliminate air entrainment while the strip is being translated at speeds of up to 600 feet per minute.

Figure 22:
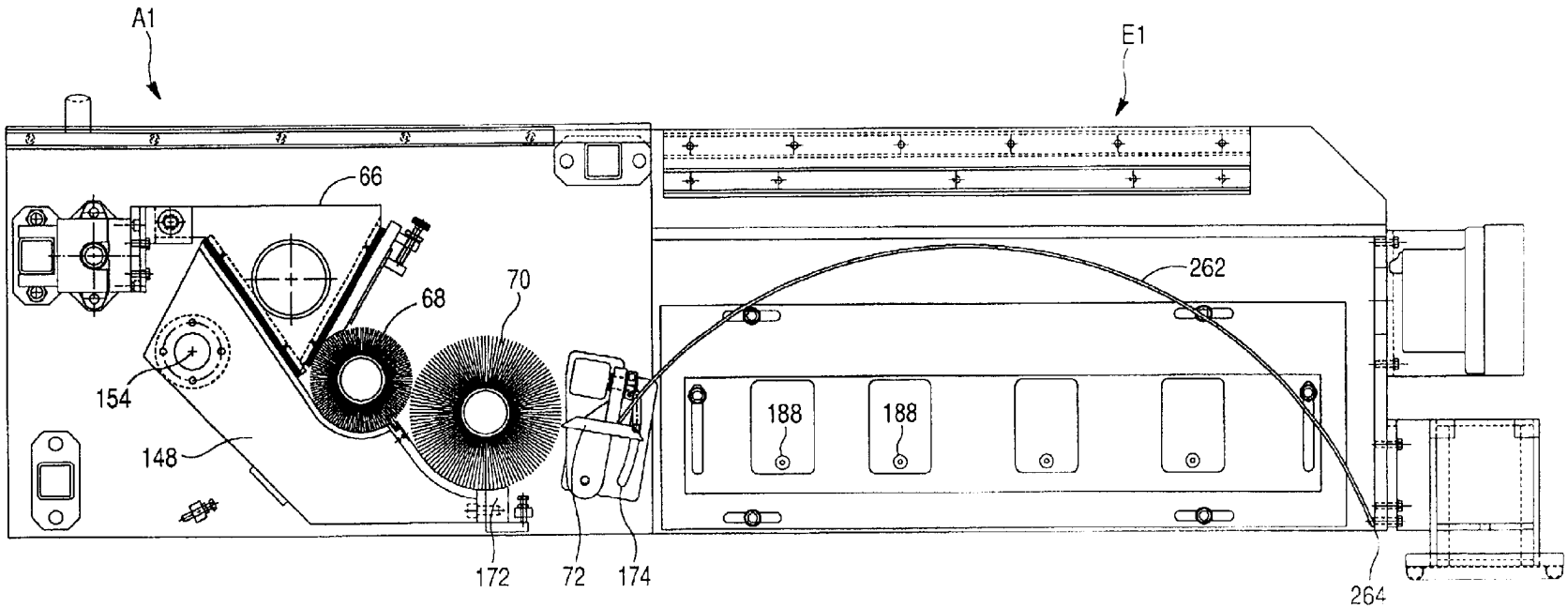
FIG. 22 is a fragmentary cross-sectional view of the powder application system of FIG. 2.
Figure 23:
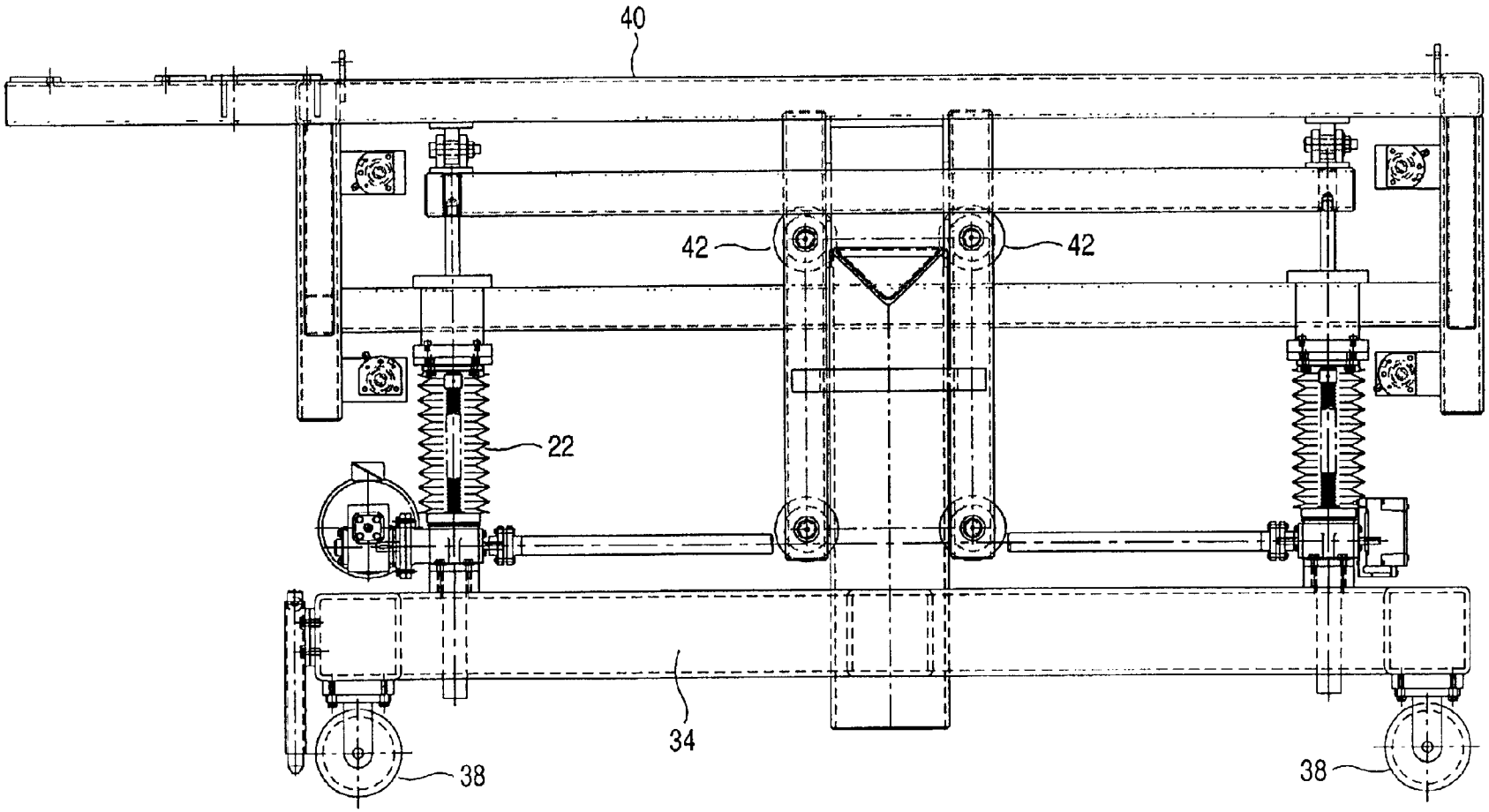
FIG. 23 is a fragmentary front elevational view of the lower frame of the powder application system of FIG. 1.

The atomizer module A1 is similar in construction to the atomizer module A. Similarly, electrostatic coating module E1 is similar to the electrostatic coating module E. Thus, as best shown in FIG. 22, like parts are identified by like reference numerals. Comparing FIGS. 22 and 9, it can be noted that the orientation of the wing 72 is different. This is because in the orientation of FIG. 9, the particulates are being upwardly directed in order to coat the lower side of the strip, whereas in the orientation of FIG. 22, the particulates are being directed downwardly to coat the strip.

The electrostatic coating module E1, as best shown in FIG. 2, is rectangular in elevation. Because of the rectangular contour of the interior of the electrostatic coating module E1, then we provide an arcuate roof 262, as best shown in FIG. 22. The roof 262 extends from the wing 72 to the terminal edge 264. The roof 262 preferably is formed of Lexan® or other non-conductive material. The roof 262 directs the flow of the particulates from the brush 70, preventing agglomeration of particulates in corners and horizontal and vertical surfaces within the interior of the electrostatic coating module E1. The powder application system PC1 is intended to provide a high quality surface on the strip. Agglomeration of powder may mar that surface when the agglomeration eventually falls. The roof 262, by providing a gentle arcuate flow path, minimizes any tendency to agglomerate.

The powder application system PC1 applies a powder coating to the topside of a metal coil. This side of the metal coil is not considered a prime coating side. A prime coating side is defined as a visually defect free coating surface. The powder application systems PC and PC1 apply a powder coating by using two zones: the atomizing and electrostatic zones. The powder is distributed from the atomizing module A or A1 using a double brush system. The double brush system is comprised of a metering brush 68 and an atomizing brush 70. The metering brush 68 controls the amount of powder coating applied/deposited to the metal coil. The atomizing brush 70 controls the velocity and distribution of the powder to the metal coil. The atomizing brush 70 directs the powder coating from the atomizing module A or A1 to the electrostatic coating module E or E1. The powder particles then pass between a series of four (4) electrode wires 188 located in a parallel plane. The powder particles receive a positive or negative electrostatic charge from the ionized air around the electrode wires 188. The charged powder particles then naturally adhere to the moving strip, due to the grounding effect of the strip. The shape of the upper electrostatic coating module E1 is typically rectangular. The enclosure is rectangular also. The enclosures 310 of electrostatic coating modules E and E1 are constructed of non-metallic material, e.g. poly-carbonate. The use of non-metallic material prevents potential electrostatic discharge from the four (4) electrode wires 188. The rectangular shape facilitates construction of the electrostatic coating module E1 with polycarbonate material.

During normal operation of the powder application system PC1, powder particles are generated from the atomizing module A1 to the electrostatic coating module E1. The majority of the powder particles pass through the electrostatic zone and land on the moving strip S. The powder particles that do not land on the strip circulate inside the rectangular chamber. Some charged powder particles can adhere to the top or side of the rectangular chamber. The charged powder particles that do not land on the strip can accumulate on the top and side surfaces due to the charged attraction forces. Over time, the accumulated charged powder particles' weight, or gravitational force, becomes greater than the charged attraction force. The accumulated charged powder particles then fall on to the moving strip called "clumping". This "clumping" is considered a visual surface defect on the coating surface.

Figure 28:
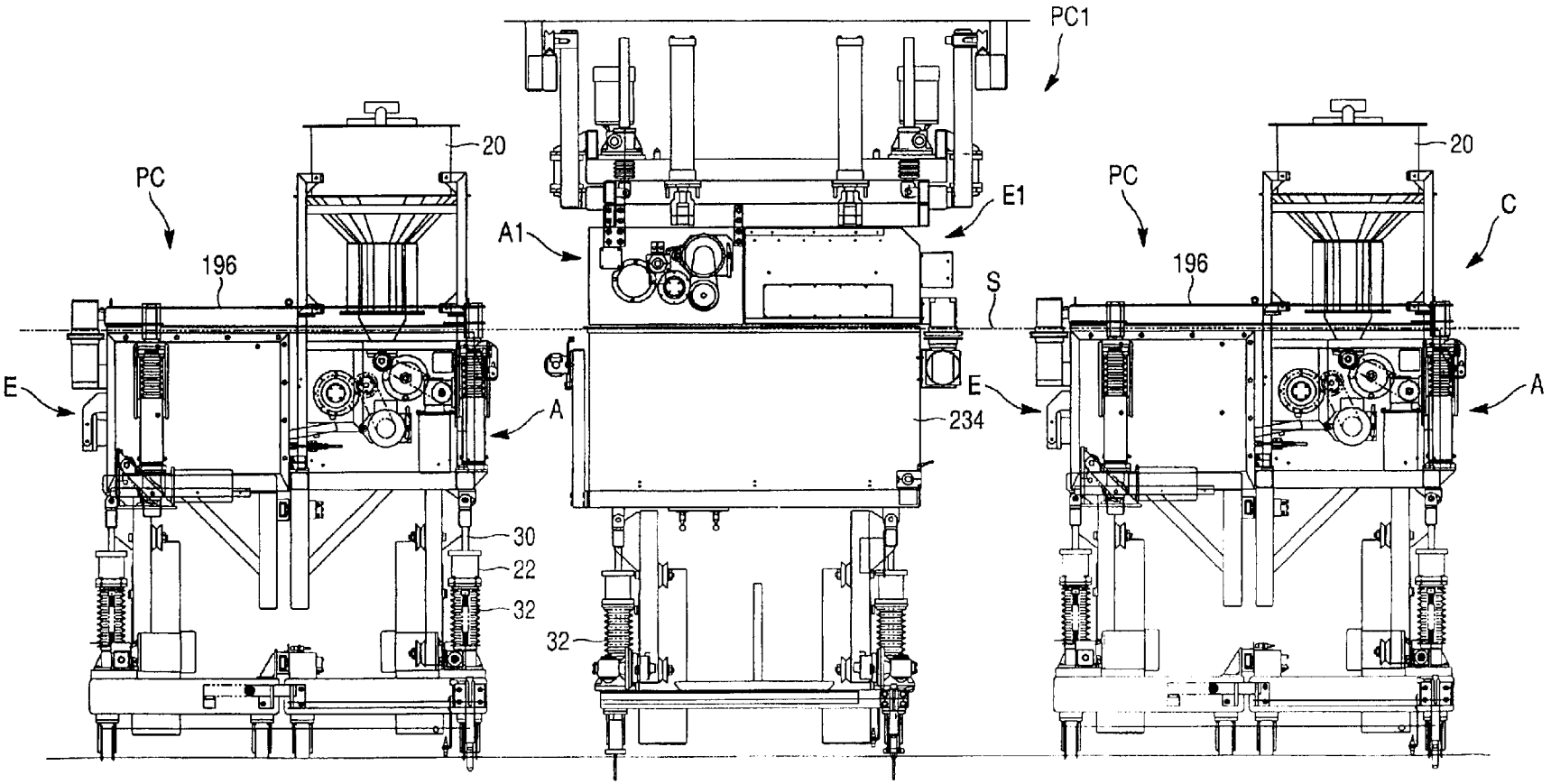
FIG. 28 is an elevational view of a coating line having the powder application systems of the invention.

As best shown in FIG. 28, a coating line C preferably has two powder application systems PC and one powder application system PC1 spaced along strip S. The two powder application systems PC are preferred in order to assure adequate powder application to the lower side of strip S. Gravity tends to pull the atomized particulates downwardly away from strip S, so two powder application systems PC permits more precise control over the coating weight or thickness along that lower side. The powder application systems PC are preferably independently operable, and thus may be used as needed and controlled as desired. Each of the powder application systems PC, for example, can apply a different coating weight onto the strip S. Gravity assists powder application system PC1, and only one such system is required. It also is operated independent of powder application systems PC, because sometimes only one side is coated or the coating weight on one side of strip S differs from the coating weight on the other side.

While this invention has been described as having a preferred embodiment, it is understood that the invention is not limited to the illustrated and described features. To the contrary, the invention is capable of further modifications, uses, and/or adaptations following the general principles of the invention and therefore includes such departures from the present disclosure as come within the known or customary practice in the art to which the invention pertains, and as may be applied to the central features set forth above, and which fall within the scope of the appended claims.

What is claimed is:

1. A modular powder application system for coating at least one side of a continuous moving substrate with powder from a powder supply, comprising:

a) an atomizer module in operative communication with a powder supply, said atomizer module having a brush that causes powder to be discharged from said atomizer module as a cloud of particulate material; and b) an electrostatic coating module operatively associated with said atomizer module and selectively displaceable relative to said atomizer module, said electrostatic coating module comprising at least one charging electrode creating an electric field, said electrostatic coating module receiving the cloud of particulate material from said atomizer module so that substrate material positioned within said electrostatic coating module will attract and thereby be coated with the particulate material within the cloud.

2. The system of claim 1, wherein:

a) said atomizer module is selectively displaceable relative to said electrostatic coating module.

3. The system of claim 1, wherein:

a) said modules are releasably secured together and thereby define a direction of movement for the substrate material; and b) each of said modules is movable transverse to said substrate direction of movement.

4. The system of claim 3, wherein:

a) at least said charging electrode is movable parallel to said direction of movement.

5. The system of claim 4, wherein:

a) there are a plurality of spaced charging electrodes, and said charging electrodes are mounted to a frame; and b) said frame is movable parallel to said direction of movement.

6. The system of claim 5, wherein:

a) a support frame is operatively associated with said electrostatic coating module;

b) said frame is movable relative to said support frame.

7. The system of claim 6, wherein:

a) a track and slider system operable interconnects said frame to said support frame.

8. The system of claim 7, wherein:

a) said track and slider system includes a pair of tracks and a pair of cooperating grooved roller assemblies, said track secured to one of said frame and said support frame and said roller assembles secured to the other of said frame and support frame.

9. The system of claim 8, wherein:

a) said tracks extend parallel to said direction of movement.

10. The system of claim 3, wherein:

a) said atomizer module includes a plurality of cooperating rotating brushes extending transverse to said direction of movement.

11. The system of claim 10, wherein:

a) at least a first drive is operatively associated with each of said modules for adjusting the modules relative to the substrate.

12. The system of claim 11, wherein:

a) each of said drives includes at least a first cylinder and piston assembly.

13. The system of claim 11, wherein:

a) each of said drives includes an electrically operable motor.

14. The system of claim 13, wherein:

a) each of said drives includes a cylinder and piston assembly cooperating with the associated electrically operable motor.

15. The system of claim 13, wherein:

a) said electrically operable motor is a variable speed motor.

16. The system of claim 10, wherein:

a) a shoe is pivotally secured to said atomizer module and operably associated with said brushes.

17. The system of claim 16, wherein:

a) said shoe includes a plurality of arcuate surfaces, each of said surfaces conforming to an associated one of said brushes.

18. The system of claim 16, wherein:

a) said shoe includes a non-conductive tip.

19. The system of claim 18, wherein:

a) said wing is movable positioned relative to said shoe.

20. The system of claim 16, wherein:

a) a wing is operatively associated with said atomizer module adjacent said shoe for directing the cloud.

21. The system of claim 1, wherein:

a) a lock assembly releasably secures said modules.

22. The system of claim 21, where said lock assembly includes:

a) at least a first bracket secured to said atomizer module and at least a first bracket secured to said electrostatic coating module; and b) a lock extending between said brackets.

23. The system of claim 22, wherein:

a) said lock includes a cylinder and piston assembly, the cylinder of said cylinder and piston assembly secured to the bracket of one of said modules and the piston of said cylinder and piston assembly secured to the bracket of the other of said modules, so that actuation of said cylinder and piston assembly causes said modules to be selectively spaced or selectively secured.

24. The system of claim 23, wherein;

a) one of the piston and the cylinder of said cylinder and piston assembly is secured to the associated module.

25. The system of claim 1, further comprising:

a) a plurality of atomizer modules and a plurality of electrostatic coating modules, each atomizer module operably associated with an electrostatic coating module and thereby providing a plurality of powder application systems.

26. The system of claim 25, wherein:

a) said powder application systems are disposed along a first side of a substrate to be coated.

27. The system of claim 26, wherein:

a) a drive is operably associated with each of said modules for adjustably positioning the module relative to the substrate to be coated.

28. The system of claim 25, wherein:

a) said powder application systems are disposed on opposite sides of a substrate to be coated.

29. The system of claim 28, wherein:

a) a drive is operably associated with each of said modules for adjustably positioning the module relative to the substrate to be coated.

30. A system for coating at least one side of a continuous moving substrate with powder from a powder supply and for allowance of enhanced operator access for maintenance of said system, said system comprising:

a powder atomizer in operative communication with a powder supply, actuation of said powder atomizer causing the powder to be discharged by an atomizer brush as a cloud of particulate material; and at least one charging electrode operatively associated with and displaceable relative to said powder atomizer and cooperating with the cloud of particulate material so that particulates from said powder atomizer are electrostatically attracted to a substrate adjacent said charging electrode.

31. The system of claim 30, wherein:

a) said powder atomizer includes a powder supply and a plurality of cooperating rotatable brushes for distributing the powder; and b) a shoe pivotally secured to said powder atomizer and disposed adjacent said brushes for communicating powder from said supply toward said charging electrode.

32. The system of claim 31, wherein:

a) at least some of said brushes rotate on spaced offset axes; and b) said shoe having a plurality of arcuate surfaces, each of said surfaces conforming to one of said brushes.

33. The system of claim 32, wherein:

a) said shoe is moveable between a first operating position and a pivoted second position.

34. The system of claim 30, wherein:

a) a wing is operatively associated with said powder atomizer adjacent brushes for directing the particulate material.

35. The system of claim 34, wherein:

a) said wing is adjustably positionable relative to said brushes.

36. The system of claim 35, wherein:

a) said brushes include a powder atomizer brush and a powder feed brush in communication with said powder supply; and b) said wing is disposed adjacent said powder atomizer brush.

37. A system for electrostatically applying powder on at least one side of a continuous moving substrate with powder from a powder supply, comprising:

a powder application system comprising a powder atomizer in operative communication with a powder supply, actuation of said powder atomizer causing powder to be discharged from said atomizer, and an electrostatic coater operatively associated with said atomizer, said electrostatic coater including at least one charging electrode creating an electric field causing the powder to be attracted to the substrate as the substrate travels adjacent to said electrostatic coater;

a cover at least partially covering said atomizer and said electrostatic coater, said cover defining a gap through which the substrate travels; and an actuating assembly operatively connected to said cover and at least one of said atomizer and said electrostatic coater and selectively spacing said cover relative to said atomizer and said electrostatic coater between an operating position and a non-operating position.

38. The system of claim 37, wherein:

a) said actuating assembly includes at least a first cylinder and piston assembly.

39. The system of claim 38, wherein:

a) there is a plurality of cylinder and piston assemblies.

40. The system of claim 39, wherein:

a) each of said cylinders and piston assemblies is disposed adjacent an end of one of said atomizer and said electrostatic coater.

41. The system of claim 37, wherein:

a) said powder application system has oppositely disposed laterally spaced planar surfaces; and b) a pair of seals extend from said cover, each seal engageable with one of said surfaces when said cover is in said operating position.

42. The system of claim 41, wherein:

a) each of said seals is formed from a resilient material.

43. The system of claim 37, wherein:

a) at least a first actuator is operably connected to said cover and at least one of said atomizer and said electrostatic coater for displacing said powder application system relative to said cover.

44. The system of claim 43, wherein:

a) there are a plurality of actuators, each actuator proximate an end of an associated one of said atomize and said electrostatic coater.

45. The system of claim 44, wherein:

a) each of said actuators is a cylinder and piston assembly.

46. The system of claim 37, wherein:

a) said atomizer is positioned within an atomizer module and said electronic coater is positioned within an electrostatic coating module; and b) said cover covers each of said modules.

47. The system of claim 46, wherein:

a) said modules are movable relative to each other.

48. A system for coating at least one surface of a substrate moving through a powder application system, comprising:

a powder atomizer in operative communication with a powder supply, actuation of said powder atomizer causing the powder to be discharged from said atomizer;

an electrostatic coater operably associated with said powder atomizer and comprising at least one charging electrode creating an electric field acting upon the discharged powder and causing the powder to be attracted to a substrate operably positioned within the electrostatic coater; and an arcuate guide within the electrostatic coater, said guide directing the discharged powder toward and within said electrostatic coater.

49. The system of claim 48, wherein:

a) said guide is formed from a non-conductive material.

50. The system of claim 49, wherein:

a) said non-conductive material is a polymer.

51. The system of claim 50, wherein:

a) said polymer is polycarbonate.

52. The system of claim 51, wherein:

a) said guide spans said electrostatic coater.

53. A coating line, comprising:

a) at least first and second powder application systems, said systems disposed on opposite sides of a substrate to be coated;

b) each of said systems including a powder atomizing component for atomizing powder and an electrostatic coater portion;

c) the atomizing component and the electrostatic coating component of at least one of said systems are relatively displaceable.

54. The coating line of claim 53, wherein:

a) there are at least two independently operable powder application systems disposed along at least one side of the strip.

* * * * *